US007624611B2

(12) United States Patent
Saitou

(10) Patent No.: US 7,624,611 B2
(45) Date of Patent: Dec. 1, 2009

(54) METHOD AND APPARATUS FOR FORMING A CUP-SHAPED MEMBER

(75) Inventor: Kazumi Saitou, Shizuoka (JP)

(73) Assignee: JATCO Ltd, Fuji-shi (JP)

( * ) Notice: Subject to any disclaimer, the term of this patent is extended or adjusted under 35 U.S.C. 154(b) by 582 days.

(21) Appl. No.: 11/298,488

(22) Filed: Dec. 12, 2005

(65) Prior Publication Data

US 2006/0125140 A1 Jun. 15, 2006

(30) Foreign Application Priority Data

Dec. 13, 2004 (JP) ..... 2004-360145
Nov. 1, 2005 (JP) ..... 2005-318279

(51) Int. Cl.
*B21D 22/00* (2006.01)

(52) U.S. Cl. ..... 72/349; 72/348

(58) Field of Classification Search ..... 72/347, 72/348, 349, 352, 358, 359, 356
See application file for complete search history.

(56) References Cited

U.S. PATENT DOCUMENTS 3,951,296 A * 4/1976 Swanson et al. ..... 220/669
4,339,939 A * 7/1982 Book et al. ..... 72/349
4,405,058 A 9/1983 Phalin
6,038,910 A * 3/2000 McClung ..... 72/348
6,233,999 B1 * 5/2001 Yabutani et al. ..... 72/354.8
6,701,603 B2 * 3/2004 Matsuura et al. ..... 29/596
7,171,838 B2 * 2/2007 Shiokawa ..... 72/356

FOREIGN PATENT DOCUMENTS

DE 32 04 946 A1 8/1982
JP 11-169980 A 6/1999
JP 2001-1060 A 1/2001
JP 2004-358553 A 12/2004

* cited by examiner

*Primary Examiner*—Edward Tolan
(74) *Attorney, Agent, or Firm*—Foley & Lardner LLP

(57) ABSTRACT

A method for forming a cup-shaped member, including a first pressing step of pressing a plate into a first cup-shaped intermediate molded body, and a second pressing step of pressing the first cup-shaped intermediate molded body into a second cup-shaped intermediate molded body having at least one annular bearing surface that extends perpendicular to an axial direction of the second cup-shaped intermediate molded body and are disposed on a radial-inward projection having an increased wall thickness. During the second pressing step, an outer circumferential periphery of the first cup-shaped intermediate molded body is ironed to facilitate plastic flow radially inwardly directed from the inner circumferential periphery thereof by restraining plastic flow directed toward an open end periphery and a bottom thereof.

17 Claims, 16 Drawing Sheets

METHOD AND APPARATUS FOR FORMING A CUP-SHAPED MEMBER

BACKGROUND OF THE INVENTION

The present invention relates to a method and an apparatus for forming a metal plate into a cup-shaped member that has an inside bearing surface on a thickened wall portion along a circumferential direction thereof. More specifically, the present invention relates to a method and an apparatus for forming a plunger for use in a belt-drive continuously variable transmission (CVT).

As generally known, a belt-drive CVT includes a drive pulley mounted to a drive shaft, a driven pulley mounted to a driven shaft and a belt connecting the drive and driven pulleys. Each of the drive and driven pulleys includes a fixed pulley half fixed to the shaft and a moveable pulley half moveable in an axial direction of the shaft. A pulley fluid pressure chamber is provided on a side of the moveable pulley half. The pulley fluid pressure chamber receives a pressurized working fluid so that the moveable pulley half is axially moved close to or apart from the fixed pulley half. This results in change in contact radii of the belt with respect to the drive pulley and the driven pulley to thereby optimally control a pulley ratio between the drive pulley and the driven pulley.

The pulley fluid pressure chamber is defined by a cylinder disposed on a side of the moveable pulley half and a plunger fixed onto an outer circumferential surface of a rotational shaft, i.e., the drive shaft or the driven shaft. The plunger has a cup-shape and a shaft insertion hole at a bottom thereof through which the rotational shaft extends. The plunger has an annular-shaped spring bearing surface on a locally thickened portion on an inner circumferential periphery of the plunger which has an increased wall thickness as compared to the remaining portion. The spring bearing surface extends in a direction perpendicular to an axial direction of the plunger. A return spring is installed between the plunger and the moveable pulley half. One end of the return spring is mounted onto the spring bearing surface of the plunger, and the other end of the return spring is mounted onto the corresponding spring bearing surface of the moveable pulley half. The moveable pulley half is biased by the return spring toward the fixed pulley half.

The plunger of the conventional art is formed by a press working or a hot forging which are shown in FIGS. 20 and 21, respectively. As illustrated in FIG. 20, the press working includes the steps of forming metal plate 2 into cup-shaped intermediate molded body A that has one open end, forming cup-shaped intermediate molded body A into cup-shaped intermediate molded body B that has a projecting bottom portion on an opposite side of the one open end, forming cup-shaped intermediate molded body B into cup-shaped intermediate molded body C that has a flange along a circumferential periphery of the one open end and a stepped portion on a side of a bottom thereof, forming cup-shaped intermediate molded body C into cup-shaped intermediate molded body D that has a flanged open end and a generally rectangular shape in vertical cross-section, forming cup-shaped intermediate molded body D into cup-shaped intermediate molded body E that has spring bearing surface 4 on a locally thickened portion located in a vertical-middle position on an inner circumference surface of the body, and forming cup-shaped intermediate molded body E into plunger 6 as a final product which has shaft insertion hole 6*a* at a bottom thereof.

As illustrated in FIG. 21, the hot forging includes the steps of forming cylindrical billet 10 into disk-shaped intermediate molded body F, forming disk-shaped intermediate molded body F into cup-shaped intermediate molded body G that has one open end, forming cup-shaped intermediate molded body G into cup-shaped intermediate molded body H that has a flange along a circumferential periphery of the one open end and spring bearing surface 12 on a thickened wall portion located in a vertical-middle position on an inner circumferential periphery of the body, and forming cup-shaped intermediate molded body H into plunger 14 as a final product which has shaft insertion hole 14*a* at a bottom thereof.

SUMMARY OF THE INVENTION

The method of forming plunger 6 by the press working as shown in FIG. 20 necessitates many steps and dies used in the steps in order to form spring bearing surface 4 on the locally thickened portion on the inner circumferential periphery of cup-shaped intermediate molded body E. This causes increase in the equipment cost and the production cost. On the other hand, the method of forming plunger 14 by the hot forging as shown in FIG. 21 does not require a relatively large press load, but it tends to cause undesired surface configurations of spring bearing surface 12 such as local bulge or large roughness. In order to eliminate the local bulge or large roughness, spring bearing surface 12 must be subjected to machining. This results in an increased production cost.

There is a demand to solve the above-described problems in the conventional art. An object of the present invention is to provide a method and an apparatus for forming a cup-shaped member that has a spring bearing surface on a radial-inward projection on an inner circumferential periphery thereof which has an increased wall thickness, and capable of reducing the equipment cost and the production cost.

According to one aspect of the present invention, there is provided a method for forming a cup-shaped member, the method comprising:

a first pressing step of pressing a plate into a first cup-shaped intermediate molded body that has a substantially uniform wall thickness; and a second pressing step of pressing the first cup-shaped intermediate molded body into a second cup-shaped intermediate molded body, the second cup-shaped intermediate molded body including at least one annular bearing surface that extends perpendicular to an axial direction of the second cup-shaped intermediate molded body, the at least one annular bearing surface being disposed on a radial-inward projection that radially inwardly extends from an inner circumferential periphery of the second cup-shaped intermediate molded body and has an increased wall thickness, wherein during the second pressing step, an outer circumferential periphery of the first cup-shaped intermediate molded body is ironed to facilitate plastic flow that is radially inwardly directed from the inner circumferential periphery thereof by restraining plastic flow that is directed toward an open end periphery and a bottom of the first cup-shaped intermediate molded body to thereby form the at least one annular bearing surface on the radial-inward projection.

According to a further aspect of the present invention, there is provided an apparatus for forming a cup-shaped member, the cup-shaped member having at least one annular bearing surface that extends perpendicular to an axial direction of the cup-shaped member, the at least one annular bearing surface being disposed on a radial-inward projection that radially inwardly extends from an inner circumferential periphery of the cup-shaped member and has an increased wall thickness, the apparatus comprising:

a first die;

a first punch cooperating with the first die to form a plate into a first cup-shaped intermediate molded body that has a substantially uniform wall thickness;

a second die; and a second punch cooperating with the second die to form the first cup-shaped intermediate molded body into a second cup-shaped intermediate molded body, the second punch including at least one annular step surface that extends perpendicular to an axial direction of the second punch and acts to form the at least one annular bearing surface of the cup-shaped member, the second die and the second punch including open-end side plastic flow restraining portions cooperating with each other to restrain plastic flow that is directed toward an open end periphery of the first cup-shaped intermediate molded body, and bottom side plastic flow restraining portions cooperating with each other to restrain plastic flow that is directed toward a bottom of the first cup-shaped intermediate molded body.

DETAILED DESCRIPTION OF THE INVENTION

Figure 11:
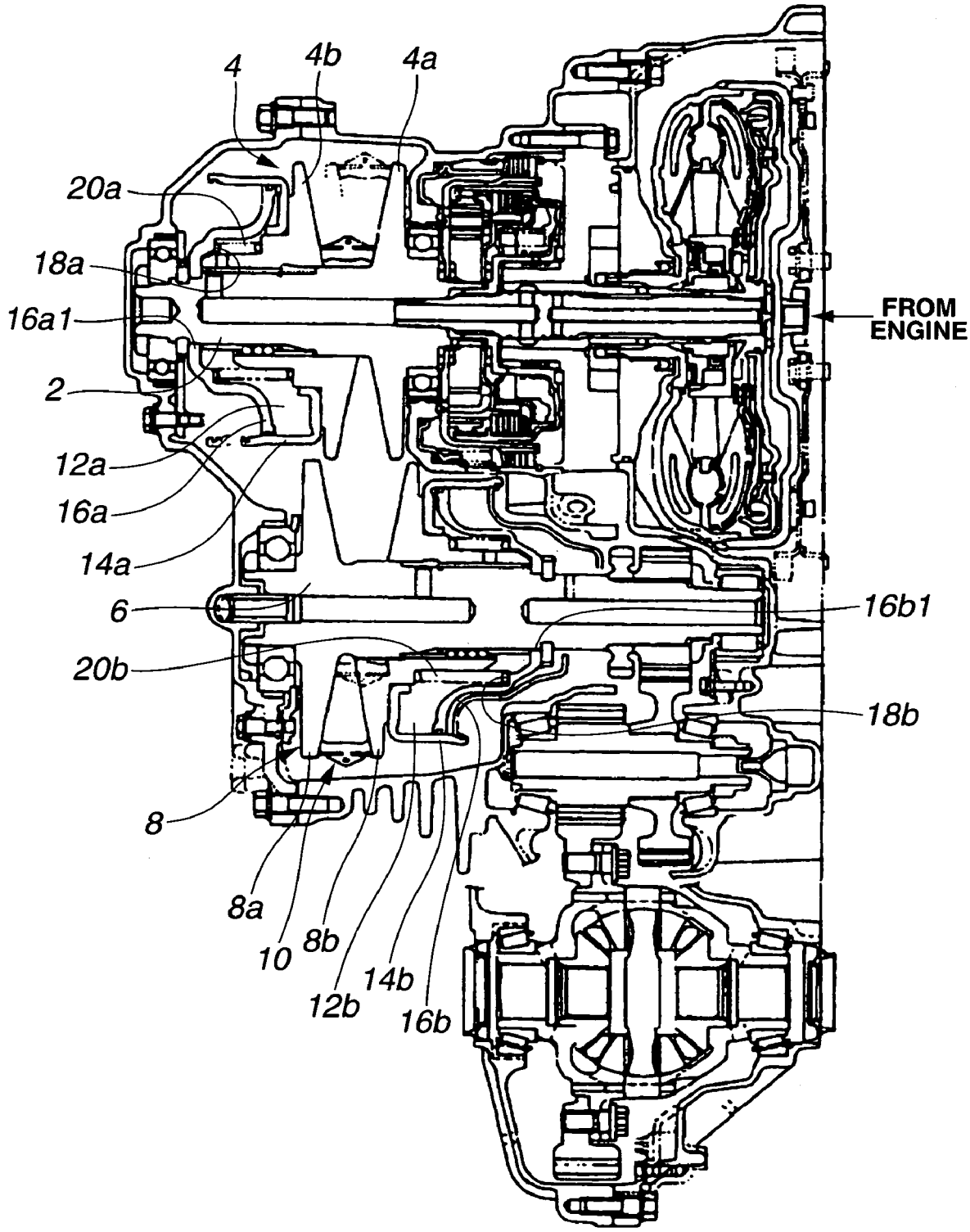
FIG. 11 is a schematic diagram that shows a belt-drive continuously variable transmission to which the cup-shaped member formed by the method and the apparatus of the first through third embodiments of the present invention is applied.

In the followings, an embodiment of the present invention will be described with reference to the accompanying drawings. The terms "upper", "lower", "upward", "downward", "rightward" and "leftward" used in the description merely denote directions as viewed in the drawings. Referring to FIG. 11, there is shown a construction of a belt-drive continuously variable transmission (CVT) to which a cup-shaped member formed by first to third embodiments of a method and apparatus according to the present invention is applied. As illustrated in FIG. 11, the belt-drive CVT includes drive pulley 4 mounted to drive shaft 2, driven pulley 8 mounted to driven shaft 6 and belt 10 connecting drive pulley 4 and driven pulley 8. Drive pulley 4 includes fixed pulley half 4*a* fixed to drive shaft 2 and moveable pulley half 4*b* moveable in an axial direction of drive shaft 2. Driven pulley 8 includes fixed pulley half 8*a* fixed to driven shaft 6 and moveable pulley half 8*b* moveable in an axial direction of driven shaft 6. Pulley fluid pressure chambers 12*a* and 12*b* to which a pressurized working fluid is supplied, are provided on a side of moveable pulley halves 4*b* and 8*b*, respectively. The supply of the pressurized working fluid is controlled by a hydraulic control unit, not shown. According to the fluid pressure supplied to pulley fluid pressure chambers 12*a* and 12*b*, moveable pulley halves 4*b* and 8*b* are axially moved close to or apart from fixed pulley halves 4*a* and 8*a*. This results in variation in contact radii of belt 10 with respect to drive pulley 4 and driven pulley 8 to thereby optimally control a pulley ratio between drive pulley 4 and driven pulley 8.

Pulley fluid pressure chamber 12*a* is defined by cylinder 14*a* disposed on the side of moveable pulley half 4*b* and plunger 16*a* fixed onto drive shaft 2. On the other hand, pulley fluid pressure chamber 12*b* is defined by cylinder 14*b* disposed on the side of moveable pulley half 8*b* and plunger 16*b* fixed onto driven shaft 6. Plungers 16*a* and 16*b* have shaft insertion holes 16*a*1 and 16*b*1 at bottoms thereof, respectively, through which drive shaft 2 and driven shaft 6 extend, respectively. Plungers 16*a* and 16*b* further have spring bearing surfaces 18*a* and 18*b* on radial-inward projections that are disposed on inner circumferential peripheries of plungers 16*a* and 16*b*, respectively. The radial-inward projections circumferentially extend and radially inwardly project on the respective inner circumferential peripheries of plungers 16*a* and 16*b*. Thus, a wall thickness of plungers 16*a* and 16*b* is increased locally, namely, at the radial-inward projections, as compared to the remaining portion of plungers 16*a* and 16*b*. Each of spring bearing surfaces 18*a* and 18*b* has an annular shape and extends in a direction perpendicular to an axial direction of each of plungers 16*a* and 16*b*. Return spring 20*a* is installed between plunger 16*a* and moveable pulley half 4*b* on drive shaft 2. One end of return spring 20*a* is mounted onto spring bearing surface 18*a*, and the other end thereof is mounted onto the corresponding portion of moveable pulley half 4*b*. Return spring 20*b* is installed between plunger 16*b* and moveable pulley half 8*b* on driven shaft 6. One end of return spring 20*b* is mounted onto spring bearing surface 18*b*, and the other end thereof is mounted onto the corresponding portion of moveable pulley half 8*b*. Return springs 20*a* and 20*b* bias moveable pulley halves 4*b* and 8*b* toward fixed pulley halves 4*a* and 8*a*, respectively.

Figure 1:
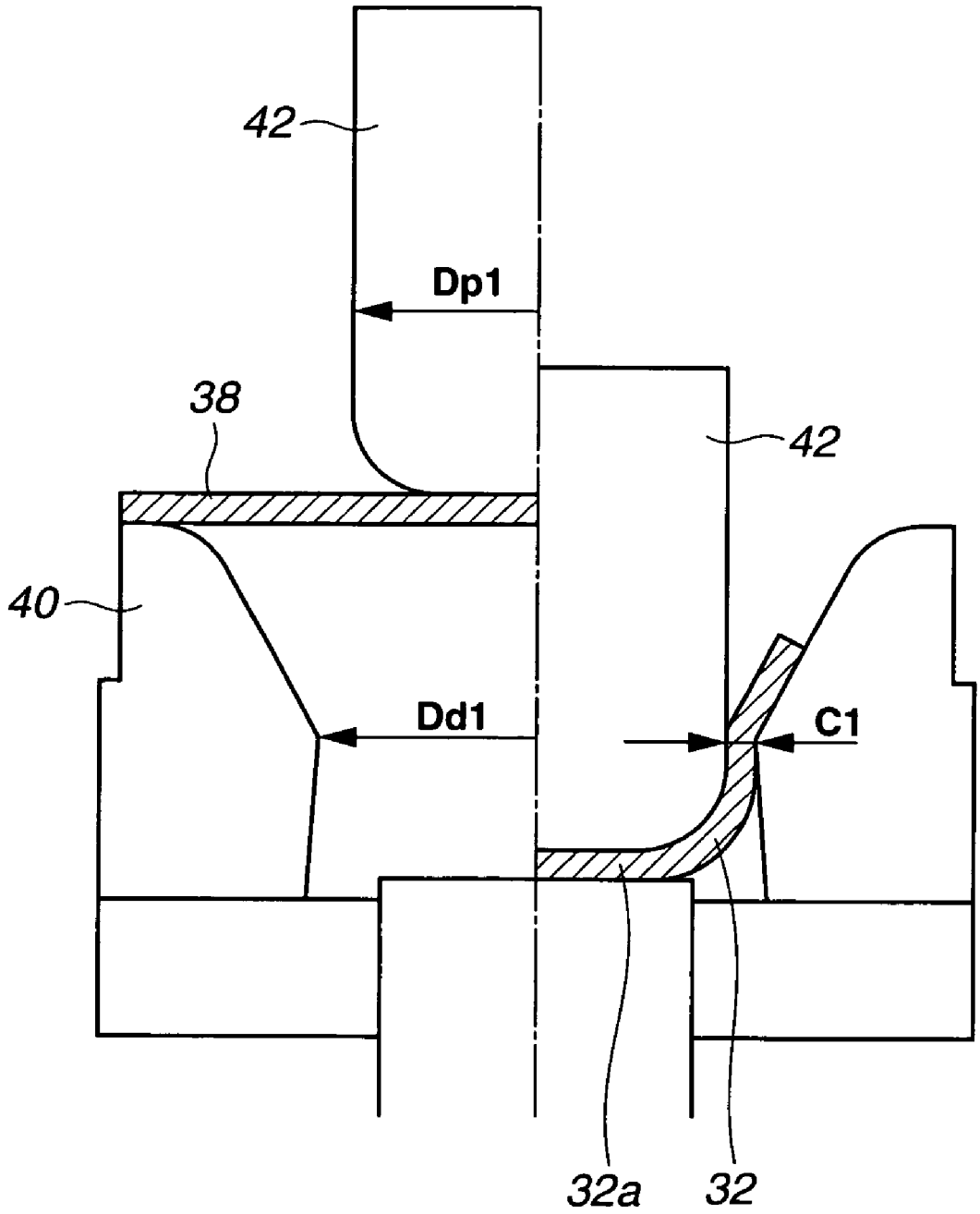
FIG. 1 is an explanatory diagram that shows a first pressing step of a method using an apparatus of a first embodiment of the present invention, when viewed in a cross-section taken along an axial direction of the apparatus.
Figure 2:
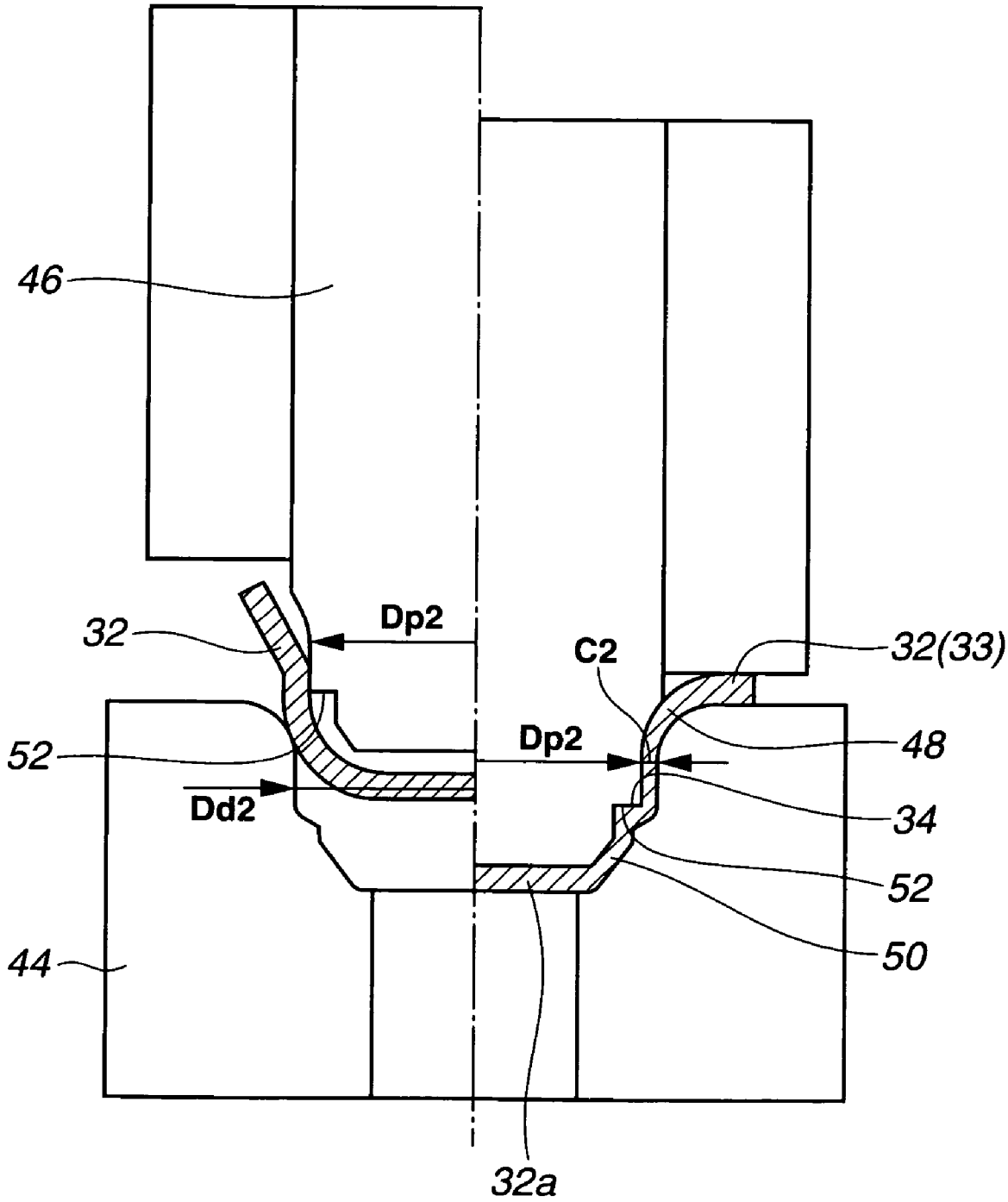
FIG. 2 is an explanatory diagram that shows a second pressing step of the method using the apparatus of the first embodiment of the present invention, when viewed in a cross-section taken along an axial direction of the apparatus.
Figure 3:
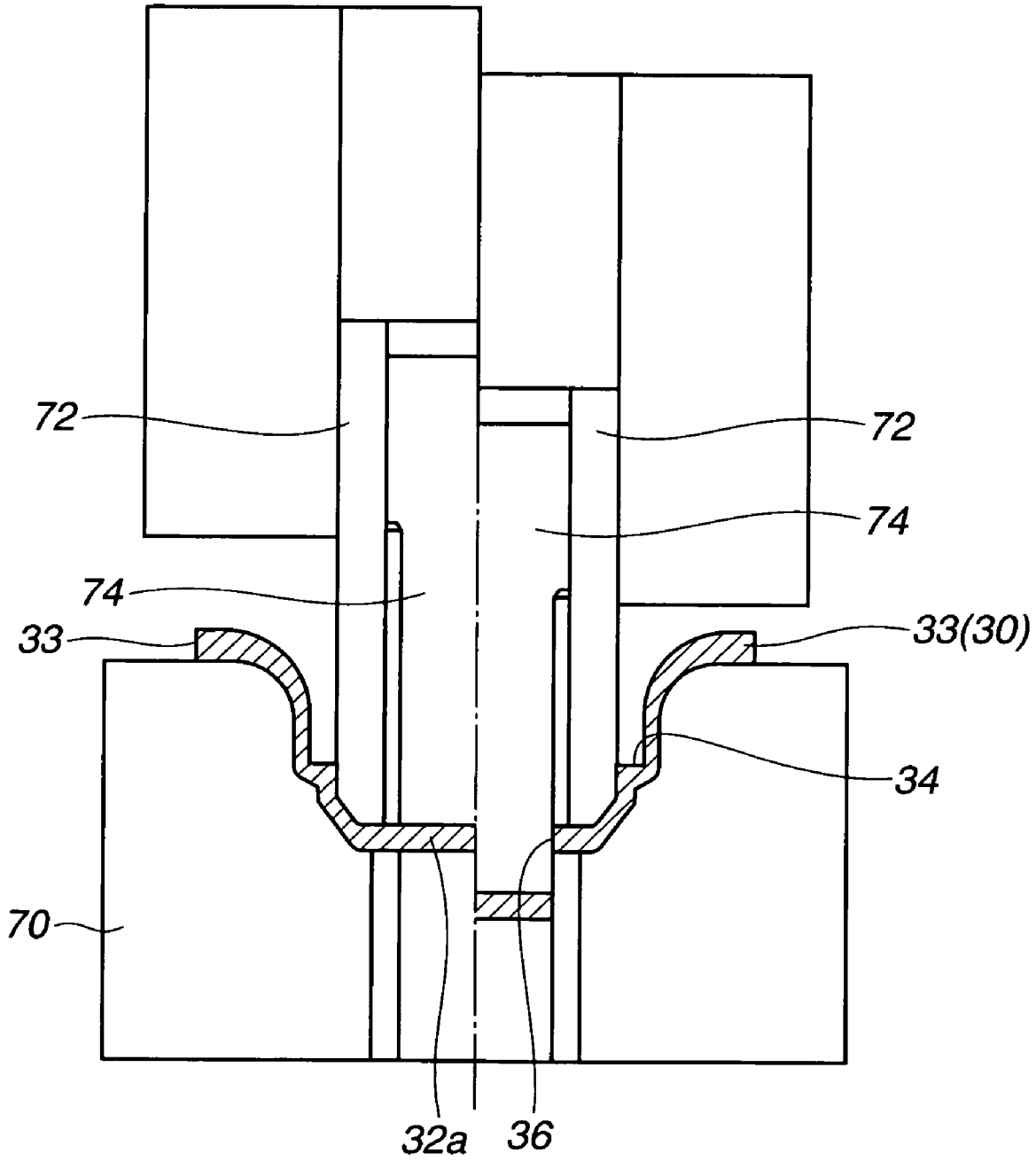
FIG. 3 is an explanatory diagram that shows a third punching step of the method using the apparatus of the first embodiment of the present invention, when viewed in a cross-section taken along an axial direction of the apparatus.

Referring to FIGS. 1-6, a first embodiment of the method and apparatus for forming a cup-shaped member, according to the present invention will be explained hereinafter. The cup-shaped member is useable as plungers 16*a* and 16*b* of the belt-drive CVT as explained above. FIG. 1 illustrates a first pressing step of the method in which first cup-shaped intermediate molded body 32 is formed using a first molding device. FIG. 2 illustrates a second pressing step of the method and a second molding device used in the second pressing step. In the second pressing step, annular bearing surface 34 is formed on an inner circumferential periphery of first cup-shaped intermediate molded body 32, while first cup-shaped intermediate molded body 32 is formed into second intermediate molded body 33 that has a generally cup-shape similar to the plunger. FIG. 3 illustrates a third punching step of the method and a third punching device used in the third punching step. In the third punching step, hole 36 is formed in planar bottom wall 32*a* of second cup-shaped intermediate molded body 33 to thereby form cup-shaped member 30 as a final molded body. The first and second molding devices and third punching device constitute the apparatus of the first embodiment. In FIGS. 1-3, a pre-state of the molding device before the molding operation is shown on a left side, and a post-state of the molding device after the molding operation is shown on a right side.

As illustrated in FIG. 1, the first molding device includes first die 40 and first punch 42 axially moveable relative to first die 40. First die 40 and first punch 42 are arranged coaxially with each other and cooperate with each other to form plate 38 into first cup-shaped intermediate molded body 32. Plate 38 is made of a suitable metal material. First die 40 includes a mold surface that defines a generally cylindrical mold cavity. The mold cavity of first die 40 has predetermined inner diameter Dd1 as shown in FIG. 1 and includes an increased-diameter portion in which the diameter is gradually increased toward an upper end thereof. First punch 42 includes a cylindrical mold portion with a planar tip end. The mold portion of first punch 42 has a mold surface that cooperates with the mold surface of first die 40. The mold portion of first punch 42 has predetermined outer diameter Dp1 smaller than inner diameter Dd1 of the mold cavity of first die 40. There is radial clearance C1 between the mold surface of first punch 42 and the corresponding mold surface of first die 40. First punch 42 is moveable to advance into the mold cavity of first die 40 and retreat therefrom, while keeping radial clearance C1 between the mold surfaces thereof.

As illustrated in FIG. 2, the second molding device includes second die 44 and second punch 46 axially moveable relative to second die 44. Second die 44 and second punch 46 are arranged coaxially with each other and cooperate with each other to form first cup-shaped intermediate molded body 32 into second cup-shaped intermediate molded body 33. Second cup-shaped intermediate molded body 33 has a central axis and at least one annular bearing surface that extends perpendicular to a direction of the central axis. The annular bearing surface is disposed on a radial-inward projection that radially inwardly extends from an inner circumferential periphery of second cup-shaped intermediate molded body 33 and has an increased wall thickness as compared to the remaining portion of a circumferential wall of second cup-shaped intermediate molded body 33. In this embodiment, there is provided one annular bearing surface 34 on the radial-inward projection. Second cup-shaped intermediate molded body 33 further includes increased-diameter portion 48 on a side of an open end thereof, a planar plate-shaped bottom wall 32*a* and reduced-diameter portion 50 connected with bottom wall 32*a*. Increased-diameter portion 48 is curved with a predetermined radius of curvature. Reduced-diameter portion 50 is bent with respect to planar bottom wall 32*a* of second cup-shaped intermediate molded body 33 so as to make a predetermined obtuse angle therebetween.

Second punch 46 includes a generally cylindrical mold portion with a stepped portion which has a mold surface. The mold portion of second punch 46 has outer diameter Dp2 that is substantially equal to outer diameter Dp1 of the mold portion of first punch 42 of the first molding device. Second die 44 includes a mold surface that defines a generally cylindrical mold cavity with a stepped portion and cooperates with the mold surface of second punch 46. The mold cavity of second die 44 has inner diameter Dd2 smaller than inner diameter Dd1 of the mold cavity of first die 40 of the first molding device. There is radial clearance C2 as shown in FIG. 2 between the mold surface of second die 44 and the corresponding mold surface of second punch 46, which is smaller than radial clearance C1 between the mold surface of first punch 42 of the first molding device and the corresponding mold surface of first die 40 of the first molding device. Second die 44 and second punch 46 include open-end side plastic flow restraining portions that cooperate with each other to restrain plastic flow of the metal material of first cup-shaped intermediate molded body 32 which is directed toward an open end periphery thereof. Second die 44 and second punch 46 further include bottom side plastic flow restraining portions that cooperate with each other to restrain plastic flow of the metal material of first cup-shaped intermediate molded body 32 which is directed toward a bottom thereof.

Figure 4:
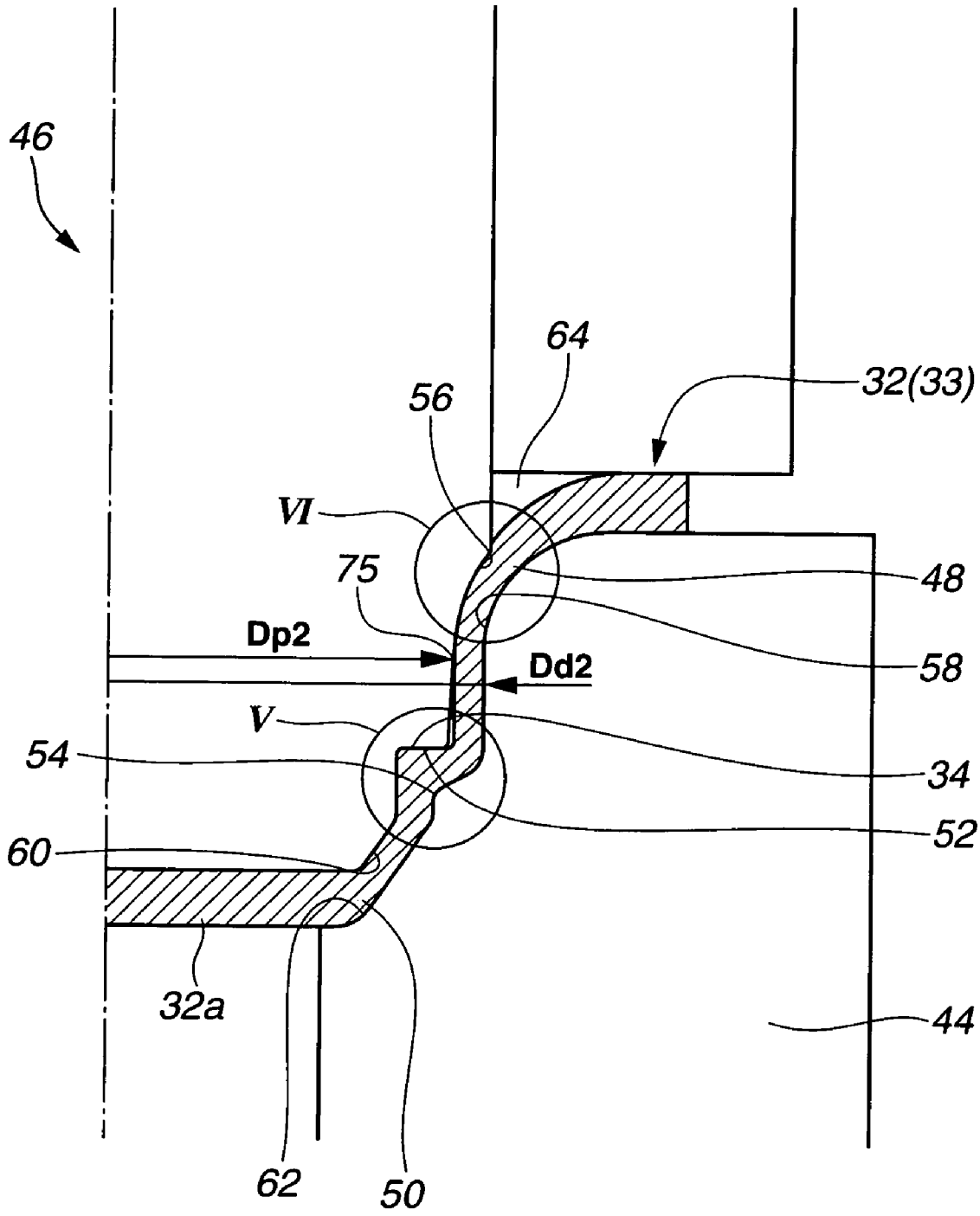
FIG. 4 is an essential part of the second pressing step of the method as shown in FIG. 2.
Figure 5:
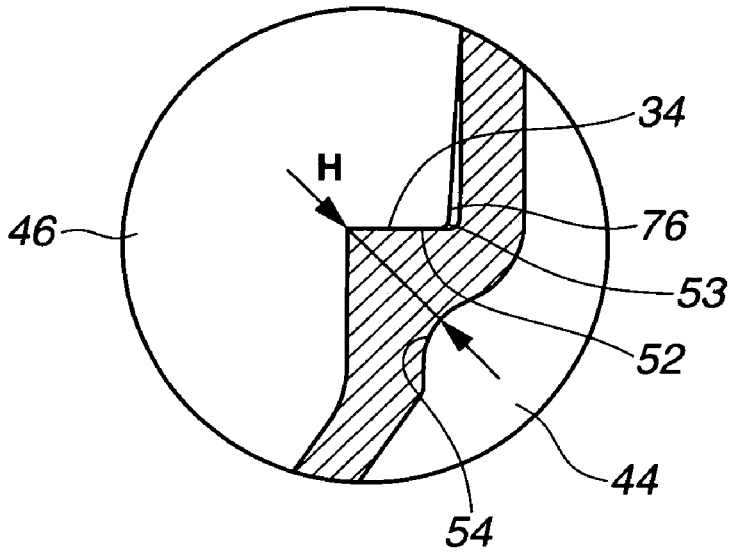
FIG. 5 is an enlarged diagram that shows a circled part as indicated at V in FIG. 4.

Specifically, as illustrated in FIG. 4, the mold portion of second punch 46 includes the stepped portion with step surface 52 that extends perpendicular to an axial direction of second punch 46. Step surface 52 is in the form of an annular planar surface. Step surface 52 acts to form annular bearing surface 34 of second cup-shaped intermediate molded body 33. As illustrated in FIG. 5, the mold portion of second punch 46 includes tapered portion 76 that is tapered toward step surface 52 and connected with step surface 52 to form the stepped portion. There is provided rounded corner 53 between step surface 52 and tapered portion 76 which has a small radius of curvature.

Figure 6:
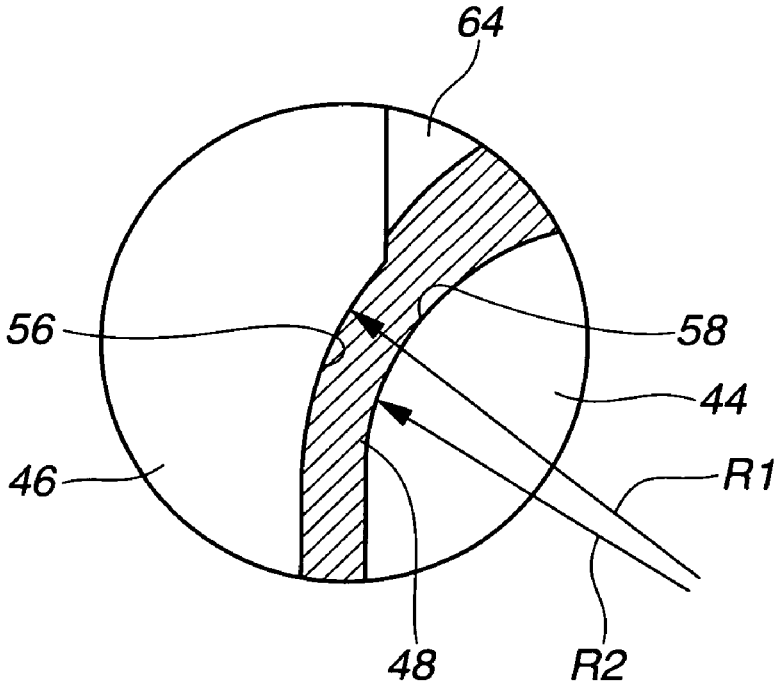
FIG. 6 is an enlarged diagram that shows a circled part as indicated at VI in FIG. 4.

The mold portion of second punch 46 includes a cylindrical mold portion continuously connected at a lower side thereof with tapered portion 76. The mold portion of second punch 46 has outer diameter Dp2 at the cylindrical mold portion which is larger than an outer diameter of annular step surface 52. As illustrated in FIG. 4, the mold portion of second punch 46 further includes increased-diameter mold surface 56 continuously connected with an upper side of the cylindrical portion that has outer diameter Dp2. Increased-diameter mold surface 56 is radially outwardly curved and has relatively large radius of curvature R1 as shown in FIG. 6. Increased-diameter mold surface 56 acts as one of the open-end side plastic flow restraining portions for restraining the plastic flow of the metal material of first cup-shaped intermediate molded body 32 which is directed toward the open end periphery thereof.

As illustrated in FIG. 4, the mold portion of second punch 46 further includes a planar bottom mold surface on a tip end thereof and reduced-diameter mold surface 60 connected with the bottom mold surface. The bottom mold surface acts to form planar bottom wall 32*a* of second cup-shaped intermediate molded body 33. Reduced-diameter mold surface 60 is downwardly spaced from step surface 52 and radially inwardly bent toward the bottom mold surface. Reduced-diameter mold surface 60 of second punch 46 is bent with respect to the bottom mold surface to make an obtuse angle therebetween. Reduced-diameter mold surface 60 acts as the other of the bottom side plastic flow restraining portions for restraining the plastic flow of the metal material of first cup-shaped intermediate molded body 32 which is directed toward the bottom thereof.

As illustrated in FIG. 4, the mold surface of second die 44 includes a cylindrical mold surface that has inner diameter Dd2, and increased-diameter mold surface 58 that is continuously connected with an upper side of the cylindrical mold surface. Increased-diameter mold surface 58 is radially outwardly curved toward an upper end surface of second die 44. As illustrated in FIG. 6, increased-diameter mold surface 58 has radius of curvature R2 slightly smaller than radius of curvature R1 of increased-diameter mold surface 56 of second punch 46. Increased-diameter mold surface 58 of second die 44 acts as the other of the open-end side plastic flow restraining portions for restraining the plastic flow of the metal material of first cup-shaped intermediate molded body 32 which is directed toward the open end periphery thereof. Increased-diameter mold surface 58 cooperates with increased-diameter mold surface 56 to form increased-diameter portion 48 of second cup-shaped intermediate molded body 33 as shown in FIG. 4.

The mold surface of second die 44 further includes step surface 54 connected with the cylindrical mold surface. Step surface 54 radially inwardly extends from a lower side of the cylindrical mold surface and is downwardly bent relative thereto. Step surface 54 cooperates with step surface 52 of second punch 46 to form annular bearing surface 34 of second cup-shaped intermediate molded body 33. The mold surface of second die 44 further includes a planar bottom mold surface and reduced-diameter mold surface 62 connected with the bottom mold surface. The bottom mold surface is disposed at a bottom of the mold cavity of second die 44 and cooperates with the bottom mold surface of second punch 46 to form planar bottom wall 32*a* of second cup-shaped intermediate molded body 33. Reduced-diameter mold surface 62 is located downwardly spaced from step surface 54. Reduced-diameter mold surface 62 is bent with respect to the bottom mold surface to make a relatively large obtuse angle therebetween which is larger than the obtuse angle of reduced-diameter mold surface 60 of second punch 46. Reduced-diameter mold surface 62 acts as the other of the bottom side plastic flow restraining portions for restraining the plastic flow of the metal material which is directed toward the bottom thereof. Reduced-diameter mold surface 62 cooperates with reduced-diameter mold surface 60 to form reduced-diameter portion 50 of second cup-shaped intermediate molded body 33.

As illustrated in FIG. 4, second die 44 and second punch 46 cooperate with each other to define non-molding space 64 on an outside of both of increased-diameter mold surface 58 of second die 44 and increased-diameter mold surface 56 of second punch 46. In non-molding space 64, first cup-shaped intermediate molded body 32 is free from being pressed by second die 44 and second punch 46.

As illustrated in FIG. 3, the third punching device includes third die 70, retainer 72 moveable relative to third die 70, and third punch 74 that is disposed coaxially with retainer 72 and axially moveable relative to third die 70. Third die 70, retainer 72 and third punch 72 cooperate with one another to form second cup-shaped intermediate molded body 33 into cup-shaped member 30 as a final molded body which has hole 36 in bottom wall 32*a* thereof. Hole 36 acts as a shaft insertion hole into which the drive shaft or the driven shaft of the belt-drive CVT is inserted.

Third die 70 has a mold cavity and a support surface that defines the mold cavity. An outside surface of second cup-shaped intermediate molded body 33 is placed on the support surface and supported thereby. Retainer 72 has a retaining surface on a tip end portion thereof, which retains an inside surface of second cup-shaped intermediate molded body 33. Specifically, the retaining surface comes into contact with an outer circumferential portion of an inside surface of bottom wall 32*a* of second cup-shaped intermediate molded body 33 and an inner circumferential surface extending between bearing surface 34 and the inside surface of bottom wall 32*a*. Third punch 74 has a punching surface that comes into contact with a central portion of the inside surface of bottom wall 32*a* of second intermediate molded body 33 and punches hole 36 through bottom wall 32*a* thereof.

Next, referring to FIGS. 1-6, the method of forming the cup-shaped member according to the present invention is explained. In the first pressing step as illustrated in FIG. 1, plate 38 is set on first die 40 of the first molding device. First punch 42 is downwardly moved into the mold cavity of first die 40 in a direction perpendicular to a planar surface of plate 38, while pressing against plate 38 set on first die 40. First cup-shaped intermediate molded body 32 having a substantially uniform wall thickness is thus formed. First cup-shaped intermediate molded body 32 includes planar bottom wall 32*a* and a flanged cylindrical side wall that has a radially outwardly extending flange on an upper end periphery thereof.

In the second pressing step as illustrated in FIG. 2, first cup-shaped intermediate molded body 32 formed in the first pressing step is set on second die 44 as shown on the left side of FIG. 2. Second punch 46 is downwardly moved into the mold cavity of second die 44 while pressing against first cup-shaped intermediate molded body 32 on second die 44. At this time, an outer circumferential periphery of first cup-shaped intermediate molded body 32 is ironed and pulled into the mold cavity of second die 44 as shown on the right side of FIG. 2. This is because radial clearance C2 between the mold surface of second punch 46 and the corresponding mold surface of second die 44 is smaller than radial clearance C1 between the mold surface of first punch 42 and the corresponding mold surface of first die 40. Thus, there occurs plastic flow of the metal material of first cup-shaped intermediate molded body 32.

Further, increased-diameter mold surface 56 of the mold portion of second punch 46 and increased-diameter mold surface 58 of the mold cavity of second die 44 cooperate with each other to press the open-end side of first cup-shaped intermediate molded body 32 therebetween and form increased-diameter portion 48 on the open-end side of second cup-shaped intermediate molded body 33. At the same time, reduced-diameter mold surface 60 of the mold portion of second punch 46 and reduced-diameter mold surface 62 of the mold cavity of second die 44 cooperate with each other to press the bottom side of first cup-shaped intermediate molded body 32 therebetween and form bottom side reduced-diameter portion 50 on the bottom side of second cup-shaped intermediate molded body 33. As a result, the plastic flow of the metal material of first cup-shaped intermediate molded body 32 which is caused by ironing the outer circumferential periphery thereof is interrupted at increased-diameter portion 48 on the open-end side and reduced-diameter portion 50 on the bottom side. The plastic flow that is radially inwardly directed from the inner circumferential periphery of first cup-shaped intermediate molded body 32 is facilitated toward step surface 52 of second punch 46. That is, the plastic flow that is directed toward the open end periphery of first cup-shaped intermediate molded body 32 is restrained by increased-diameter mold surface 56 of second punch 46 and increased-diameter mold surface 58 of second die 44. The plastic flow that is directed toward the bottom of first cup-shaped intermediate molded body 32 is restrained by reduced-diameter mold surface 60 of second punch 46 and reduced-diameter mold surface 62 of second die 44. Then, the plastic flow that is radially inwardly directed smoothly runs along tapered surface 76 adjacent to step surface 52 such that wall thickness H as shown in FIG. 5, of first cup-shaped intermediate molded body 32 between step surface 52 of second punch 46 and step surface 54 of second die 44 is radially inwardly increased to thereby form the radial-inward projection on the inner circumferential periphery and annular bearing surface 34 on the radial-inward projection. As a result, thus-formed second cup-shaped intermediate molded body 33 has the increased wall thickness H at the radial-inward projection on which annular bearing surface 34 is located.

In the third punching step as illustrated in FIG. 3, second cup-shaped intermediate molded body 33 formed in the second pressing step is set on third die 70. Retainer 72 is downwardly moved into the cavity of third die 70 and placed on second intermediate molded body 33 on third die 70. At this time, retainer 72 is in contact with the outer circumferential portion of the inside surface of bottom wall 32*a* of second intermediate molded body 33. Retainer 72 cooperates with third die 70 to support bottom wall 32*a* of second cup-shaped intermediate molded body 33 therebetween. Subsequently, third punch 74 is downwardly moved and punches hole 36 at a central portion of bottom wall 32*a* of second cup-shaped intermediate molded body 33. Thus, cup-shaped member 30 that has annular bearing surface 34 on the locally thickened wall portion and hole 36 in bottom wall 32*a*, is formed.

As explained above, according to the first embodiment of the present invention, in the second pressing step after the first pressing step in which first cup-shaped intermediate molded body 32 having a substantially uniform wall thickness is formed, the outer circumferential wall portion of first cup-shaped intermediate molded body 32 is ironed to cause plastic flow of the metal material of first cup-shaped intermediate molded body 32 and restrain the plastic flow directed toward the open end periphery and bottom wall 32*a* of first cup-shaped intermediate molded body 32 by forming increased-diameter portion 48 on the open end side and reduced-diameter portion 50 on the bottom side. This results in facilitating the plastic flow directed toward step surface 52 of second punch 46 to thereby form bearing surface 34 on the radial-inward projection that has the increased wall thickness. Thus, in the first embodiment of the present invention, second cup-shaped intermediate molded body 33 having bearing surface 34 on the radial-inward projection that has the increased wall thickness can be formed by the number of steps of the method that is reduced as compared to the conventional art.

Further, according to the first embodiment of the present invention, in the third punching step of the method, hole 36 is formed in bottom wall 32*a* of second cup-shaped intermediate molded body 33. Thus, by conducting the first and second pressing steps and the third punching step, cup-shaped member 30 that has annular bearing surface 34 on the radial-inward projection with the increased-thickness and hole 36 in bottom wall 32*a* is formed. As a result, the first embodiment of the present invention can reduce the number of steps of forming a cup-shaped member, and can be therefore more suitably applied to production of a plunger of a belt-drive CVT, as compared to the conventional method. This serves for reducing the number of dies and punches for use in the molding apparatus for forming the cup-shaped member, and therefore, reducing the equipment cost and the production cost.

Further, in the apparatus of the first embodiment of the present invention, outer diameter Dp2 of the mold portion of second punch 46 is substantially equal to outer diameter Dp1 of the mold portion of first punch 42, and inner diameter Dd2 of the mold cavity of second die 44 is smaller than inner diameter Dd1 of the mold cavity of first die 40. With the construction of first and second punches 42 and 46 and first and second dies 40 and 44, when first cup-shaped intermediate molded body 32 is urged into the mold cavity of second die 44 by second punch 46 while being pressed therebetween, the outer circumferential periphery of first cup-shaped intermediate molded body 32 is forcibly ironed.

Further, with the provision of tapered surface 76 adjacent to step surface 52 of second punch 46, the plastic flow of the metal material of first cup-shaped intermediate molded body 32 which is radially inwardly directed can be smoothly caused along tapered surface 76 so as to increase a wall thickness at the radial-inward projection on which annular bearing surface 34 is located. This results in facilitating and ensuring the formation of annular bearing surface 34. Further, annular bearing surface 34 can be provided in the form of a planar surface without local bulge or large roughness that tends to occur on the bearing surface of the cup-shaped member of the conventional art. This results in omitting machining of the bearing surface for removing the local bulge or large roughness therefrom, thereby serving for reducing the production cost.

Further, increased-diameter mold surface 56 of second punch 46 has relatively large radius of curvature R1, and increased-diameter mold surface 58 of second die 44 has radius of curvature R2 smaller than radius of curvature R1 of increased-diameter mold surface 56. With the provisions of increased-diameter mold surface 56 of second punch 46 and increased-diameter mold surface 58 of second die 44, when first cup-shaped intermediate molded body 32 is urged into the mold cavity of second die 44 by second punch 46 while being pressed therebetween, the open-end side of first cup-shaped intermediate molded body 32 is pressed and formed into increased-diameter portion 48 of second cup-shaped intermediate molded body 33. Furthermore, with the provisions of inclined mold surface 60 of second punch 46 and inclined mold surface 62 of second die 44, the bottom side of first cup-shaped intermediate molded body 32 is pressed and formed into reduced-diameter portion 50 of second cup-shaped intermediate molded body 33. As a result, the plastic flow toward the open-end side of first cup-shaped intermediate molded body 32 is interrupted at increased-diameter portion 48, and the plastic flow toward the bottom side of first cup-shaped intermediate molded body 32 is interrupted at reduced-diameter portion 50. The radially inward plastic flow can be facilitated so as to increase the wall thickness at the radial-inward projection on which bearing surface 34 is located.

Further, with the provision of non-molding space 64 on the outside of both of increased-diameter mold surface 58 of second die 44 and increased-diameter mold surface 56 of second punch 46, increased-diameter portion 48, reduced-diameter portion 50 and bearing surface 34 of second cup-shaped intermediate molded body 33 can be formed by a minimum molding load in the second pressing step.

Further, in the apparatus of the first embodiment of the present invention, the cup-shaped member useable as a plunger of a belt-drive CVT can be formed by the reduced number of dies and punches as compared to the conventional art. This serves for simplifying the apparatus and reducing the equipment cost and the production cost.

Figure 7:
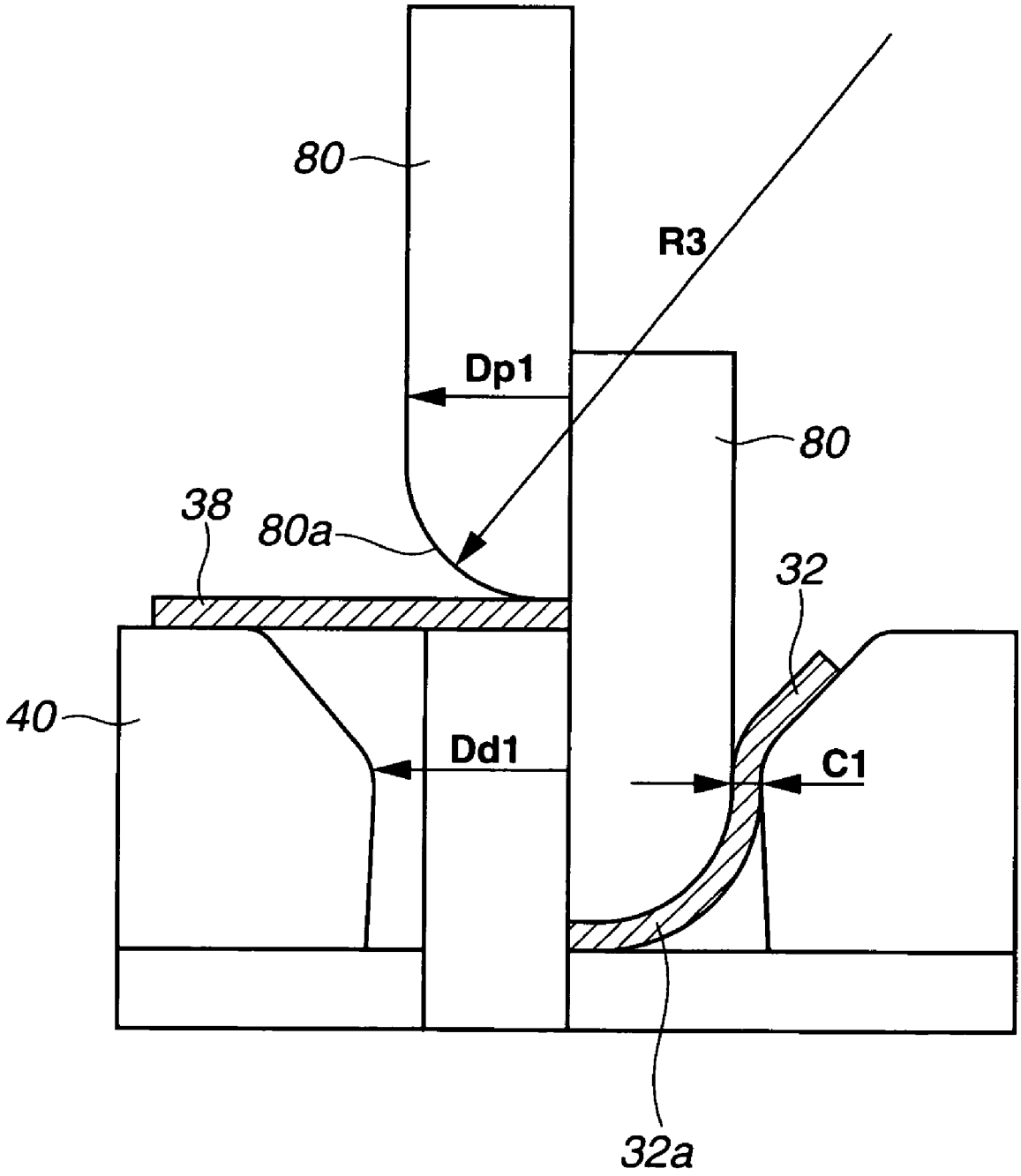
FIG. 7 is an explanatory diagram that shows a first pressing step of a method using an apparatus of a second embodiment of the present invention, when viewed in a cross-section taken along an axial direction of the apparatus.
Figure 8:
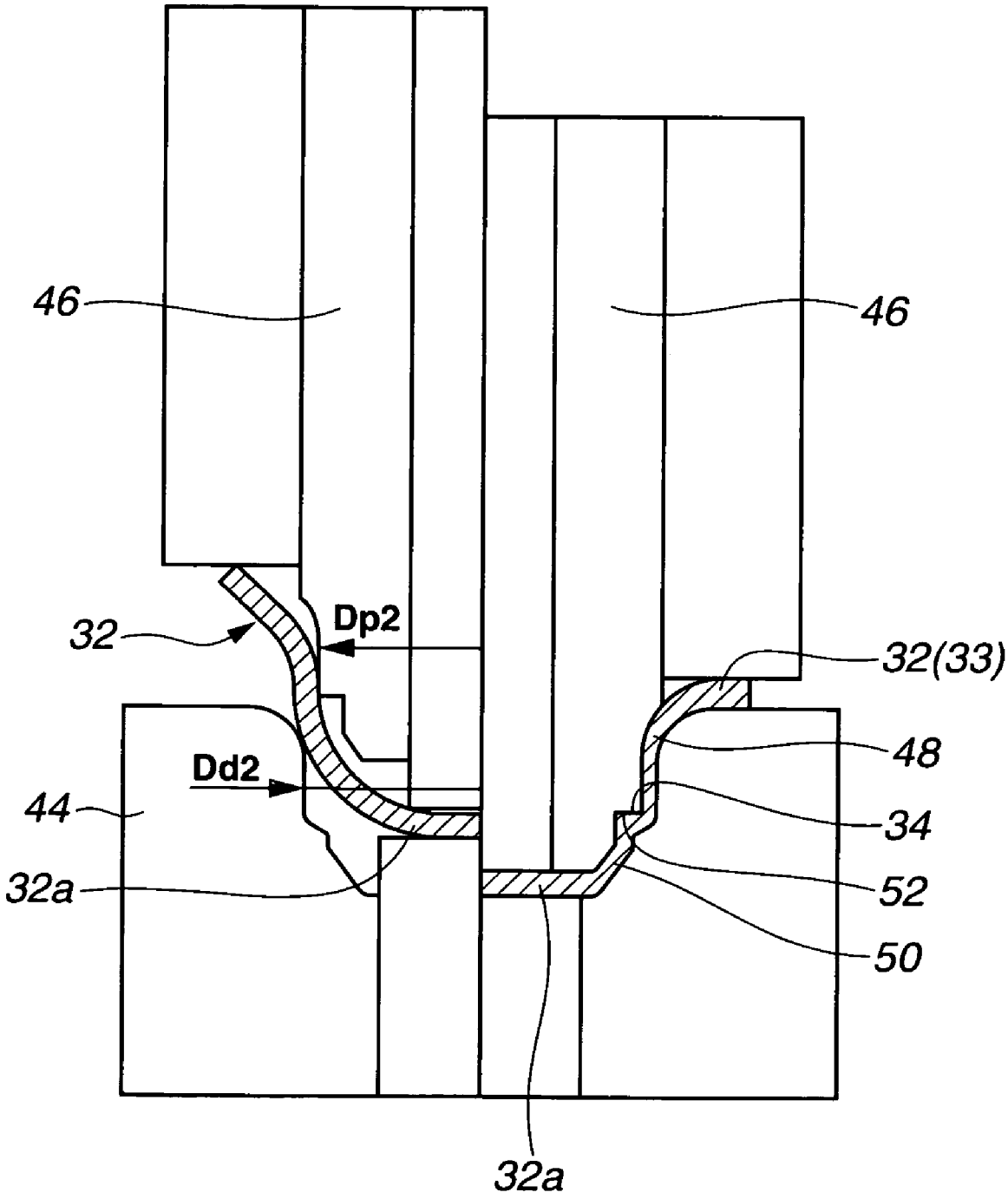
FIG. 8 is an explanatory diagram that shows a second pressing step of the method using the apparatus of the second embodiment of the present invention, when viewed in a cross-section taken along an axial direction of the apparatus.

Referring to FIGS. 7-8, a second embodiment of the apparatus of the present invention is explained, which differs from the first embodiment in shape of the first punch of the first molding device which is used in the first pressing step. Like reference numerals denote like parts, and therefore, detailed explanations therefor are omitted. In FIGS. 7-8, a pre-state of the apparatus before the forming operation is shown on a left side, and a post-state of the apparatus after the forming operation is shown on a right side. As illustrated in FIG. 7, the first molding device includes first punch 80 that has rounded tip end 80*a* that has a part-spherical shape in section and predetermined radius of curvature R3. In the first pressing step using the first molding device as shown in FIG. 7, first punch 80 is downwardly moved into the mold cavity of first die 40 while pressing against plate 38 set on first die 40. Thus, plate 38 is formed into first cup-shaped intermediate molded body 32 that has a substantially uniform wall thickness and generally part-spherical bottom wall 32*a*.

Subsequently, in the second pressing step as illustrated on the left side of FIG. 8, first cup-shaped intermediate molded body 32 with part-spherical bottom wall 32*a* is set on second die 44. Then, as illustrated on the right side of FIG. 8, second punch 46 is downwardly moved into the mold cavity of second die 44 while pressing against first cup-shaped intermediate molded body 32. Since part-spherical bottom wall 32*a* of first cup-shaped intermediate molded body 32 is increased in volume as compared to planar bottom wall 32*a* of first cup-shaped intermediate molded body 32 formed in the first embodiment as shown on the left side of FIG. 2, plastic flow of the metal material which is radially inwardly caused between step surface 52 of second punch 46 and step surface 54 of second die 44 can be facilitated. This promotes increase in wall thickness to thereby form the radial-inward projection with annular bearing surface 34.

Figure 9:
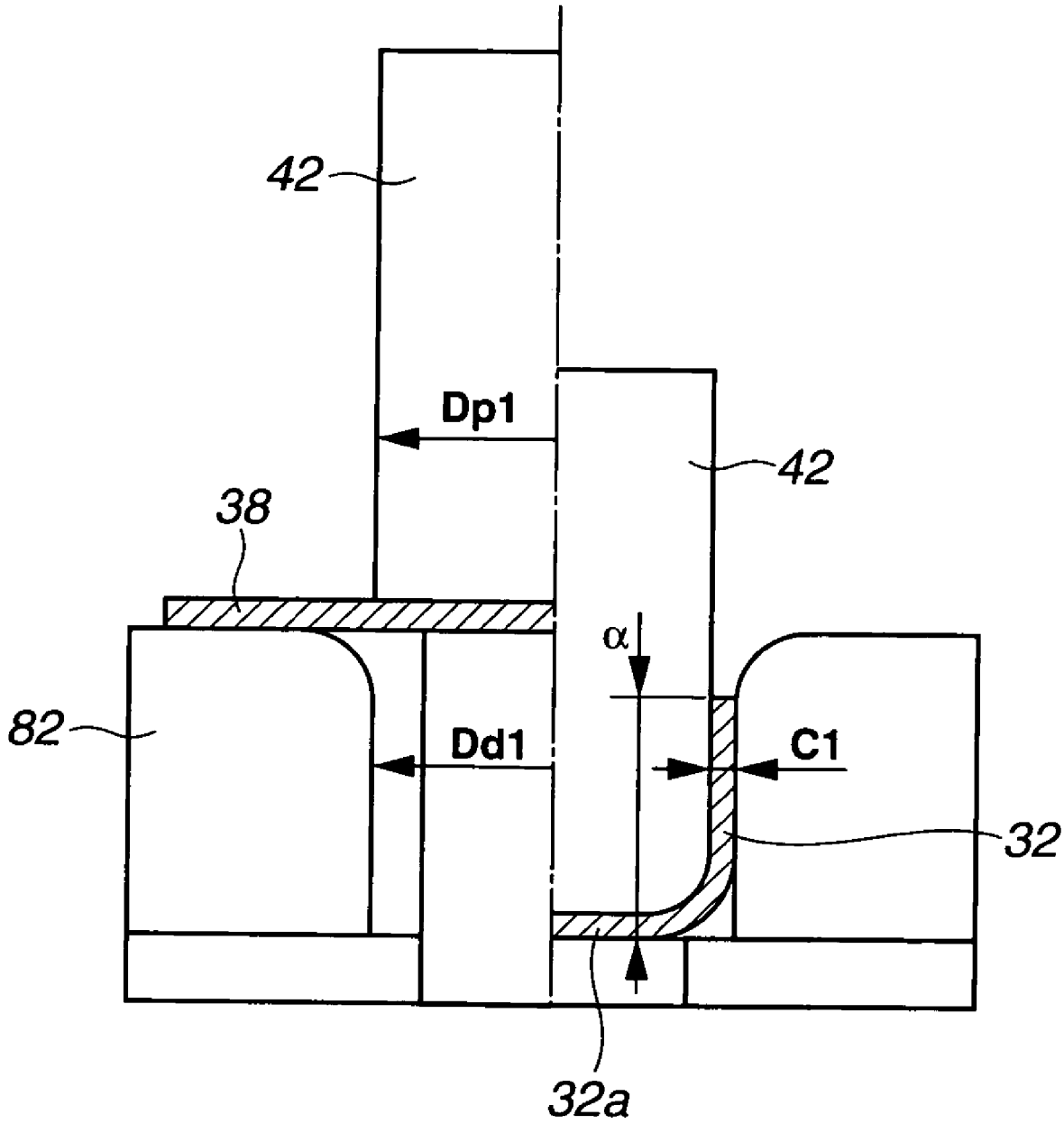
FIG. 9 is an explanatory diagram that shows a first pressing step of a method using an apparatus of a third embodiment of the present invention, when viewed in a cross-section taken along an axial direction of the apparatus.
Figure 10:
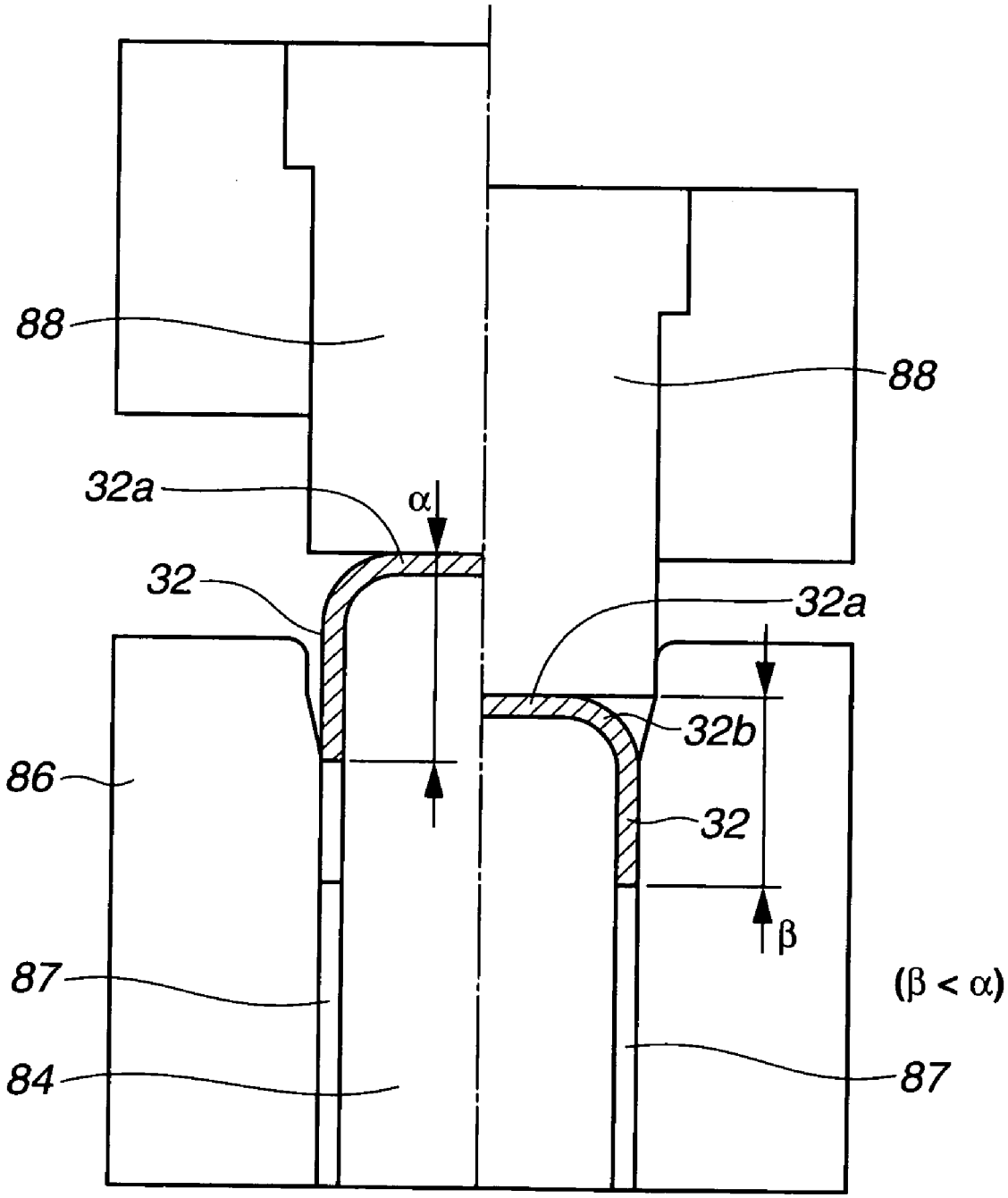
FIG. 10 is an explanatory diagram that shows a wall thickness increasing step of the method using the apparatus of the third embodiment of the present invention, when viewed in a cross-section taken along a axial direction of the apparatus, when viewed in a cross-section taken along an axial direction of the apparatus.

Referring to FIGS. 9-10, a third embodiment of the apparatus of the present invention is explained. The third embodiment differs from the first embodiment in shape of the first die of the first molding device which is used in the first pressing step, and in provision of a wall-thickness increasing device that is used in a wall-thickness increasing step between the first and second pressing steps. As illustrated in FIG. 9, the first molding device includes first die 82 has a cylindrical mold surface that defines a cylindrical mold cavity. The mold cavity of first die 82 has predetermined inner diameter Dd1 without gradually increasing toward an upper end thereof in contrast to the mold cavity of first die 40 of the first molding device of the first embodiment.

As illustrated in FIG. 10, the wall thickness increasing device includes inner die 84, outer die 86, end face retainer 87, and wall thickness increasing punch 88. Inner die 84 retains an inner circumferential periphery of first cup-shaped intermediate molded body 32 set thereon in an upset state in which the open end of first cup-shaped intermediate molded body 32 is downwardly located. Outer die 86 retains an outer circumferential periphery of first cup-shaped intermediate molded body 32 that is set in the upset state. End face retainer 87 is arranged between inner die 84 and outer die 86 and retains an annular surface of the open end of first cup-shaped intermediate molded body 32 in contact therewith. Wall thickness increasing punch 88 is downwardly moveable into the mold cavity of outer die 86.

In the first pressing step using the first molding device in the third embodiment as illustrated in FIG. 9, first punch 42 is downwardly moved in the mold cavity of first die 82 while pressing against plate 38 set on first die 82. Thus, plate 38 is formed into first cup-shaped intermediate molded body 32 including planar bottom wall 32*a* and a cylindrical side wall without a radially outwardly extending upper flange. Namely, the cylindrical side wall of first cup-shaped intermediate molded body 32 has no increased-diameter portion that is increased in diameter toward the open end periphery thereof, in contrast to that of first cup-shaped intermediate molded body 32 formed in the first embodiment. As shown on the right side of FIG. 9, first cup-shaped intermediate molded body 32 formed in the first pressing step in the third embodiment has height $\alpha$ that extends from an end face of the open end periphery to an outer surface of bottom wall 32*a*.

Subsequent to the first pressing step, the wall thickness increasing step is conducted using the wall thickness increasing device as illustrated in FIG. 10. In the wall thickness increasing step, a wall thickness of an area of first cup-shaped intermediate molded body 32 in which annular bearing surface 34 is formed, is increased. First cup-shaped intermediate molded body 32 is set on inner die 84 at the upset state in which planar bottom wall 32*a* is located on an upper side. Then, wall-thickness increasing punch 88 is downwardly moved onto planar bottom wall 32*a* and pressed thereagainst in the axial direction thereof until axial distance $\beta$ between a tip end face of wall-thickness increasing punch 88 and an upper end face of end face retainer 87 becomes slightly smaller than height a of first cup-shaped intermediate molded body 32. As a result, the wall thickness of portion 32*b* of the side wall of first cup-shaped intermediate molded body 32 in which annular bearing surface 34 on the radial-inward projection is formed, is increased. Subsequent to completion of the wall-thickness increasing step, first cup-shaped intermediate molded body 32 having the locally increased wall thickness is subjected to the second pressing step as explained in the first embodiment.

As explained above in the first pressing step of the method in the third embodiment, there is provided first cup-shaped intermediate molded body 32 that has planar bottom wall 32*a* and the cylindrical side wall without being increased in diameter at the open end periphery. Subsequently, first cup-shaped intermediate molded body 32 is axially pressed to increase the wall thickness of portion 32*b* that is formed into the radial-inward projection with annular bearing surface 34. Accordingly, this can considerably facilitate the increase in wall thickness of first cup-shaped intermediate molded body 32 toward portion 32*b*.

Figure 19:
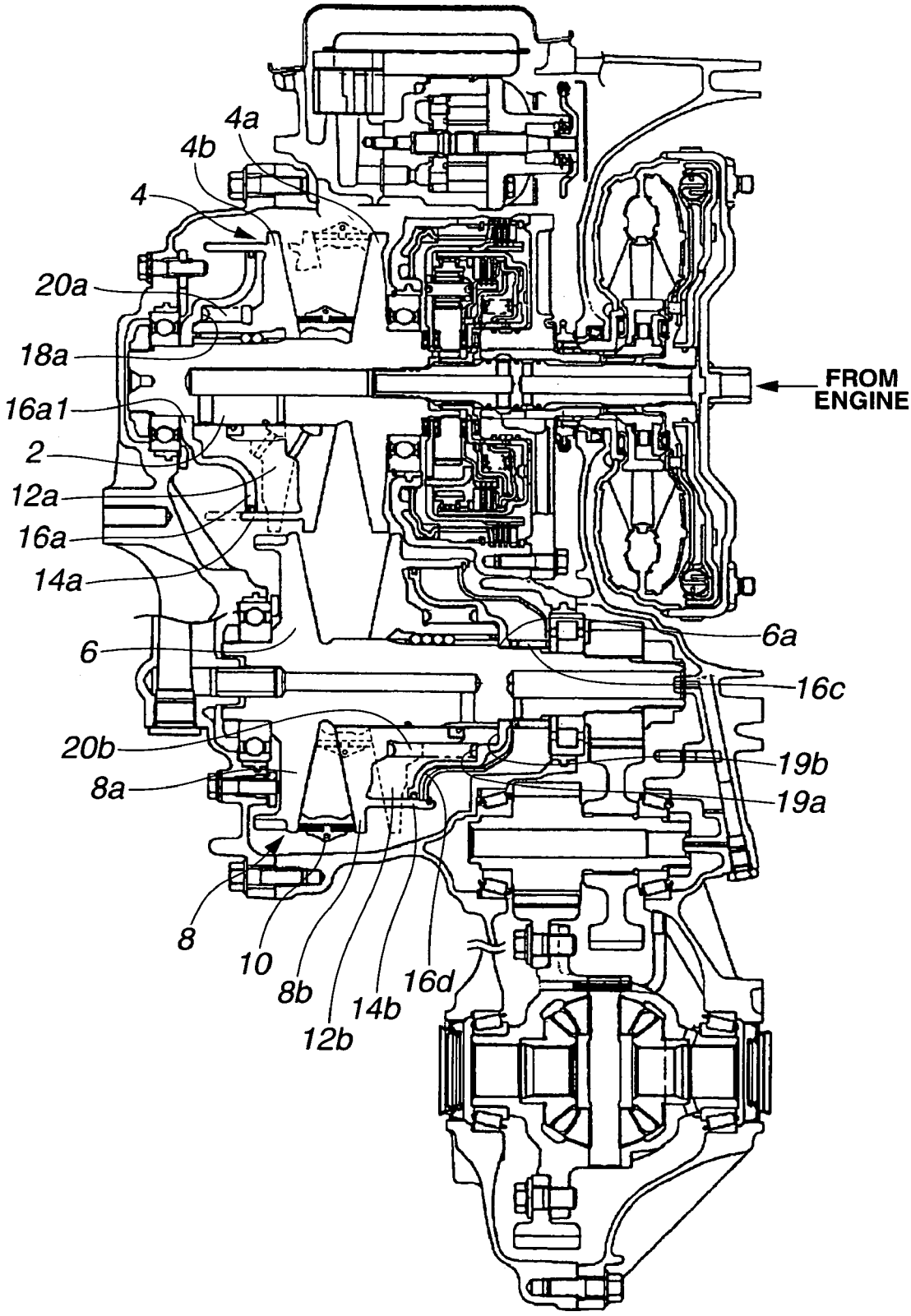
FIG. 19 is a schematic diagram that shows a belt-drive continuously variable transmission to which the cup-shaped member formed by the method and the apparatus of the fourth embodiment of the present invention is applied.
Figure 20:
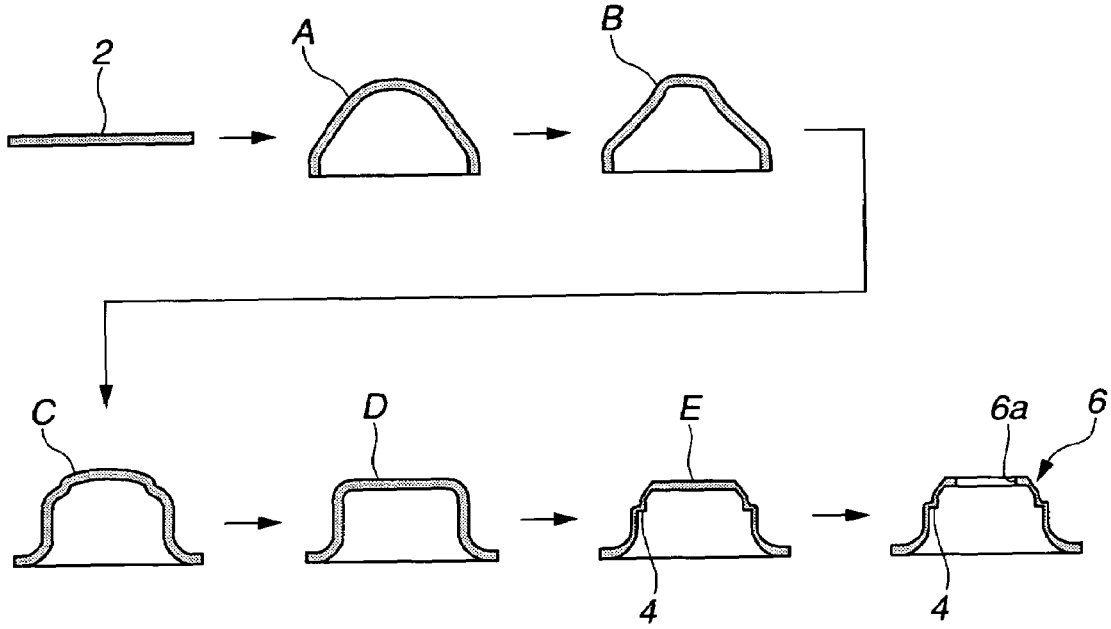
FIG.20 (PRIOR ART)
FIG. 20 is a diagram that shows one example of a conventional method for forming a cup-shaped member.
Figure 21:
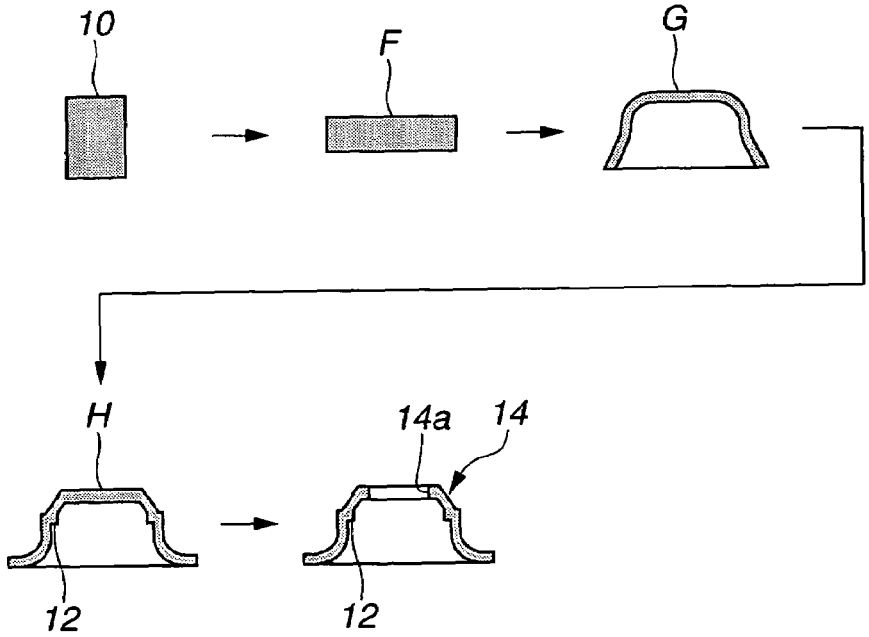
FIG.21 (PRIOR ART)
FIG. 21 is a diagram that shows another example of the conventional method for forming a cup-shaped member.

Referring to FIG. 19, there is shown a construction of a belt-drive CVT to which a cup-shaped member formed by a fourth embodiment of a method and apparatus according to the present invention is applied. The belt-drive CVT as shown in FIG. 19 is similar to that as shown in FIG. 11. Like reference numerals denote like parts, and therefore, detailed explanations therefor are omitted. As illustrated in FIG. 19, driven pulley 8 mounted to driven shaft 6 includes fixed pulley half 8*a* fixed to driven shaft 6 and moveable pulley half 8*b* moveable in an axial direction of driven shaft 6. Pulley fluid pressure chamber 12*b* is provided on a side of moveable pulley half 8*b*.

Pulley fluid pressure chamber 12*b* is defined by cylinder 14*b* integrally formed with moveable pulley half 8*b* and plunger 16*d* fixed onto driven shaft 6. Plunger 16*d* has sleeve 16*c* at bottoms thereof which is fitted onto driven shaft 6. Plunger 16*d* further has first and second spring bearing surfaces 19*a* and 19*b* that are axially spaced from each other and disposed on radial-inward projections on an inner circumferential periphery of plunger 16*d*. The radial-inward projections circumferentially extend and radially inwardly extend from the inner circumferential periphery of plunger 16*d*. Thus, a wall thickness of plunger 16*d* is increased locally, namely, at the radial-inward projections, as compared to the remaining portion of a plunger 16*d*. Each of spring bearing surfaces 19*a* and 19*b* has an annular shape and extends in a direction perpendicular to an axial direction of plunger 16*d*.

Sleeve 16*c* of plunger 16*d* is fitted onto driven shaft 6 in such a manner that second spring bearing surface 19*b* is in contact with step surface 6*a* that is formed on an outer circumferential surface of driven shaft 6. Return spring 20*b* is installed between plunger 16*d* and moveable pulley half 8*b*. One end of return spring 20*b* is mounted onto first spring bearing surface 19*a* of plunger 16*d*, and the other end thereof is mounted onto the corresponding portion of moveable pulley half 8*b*. Return spring 20*b* biases moveable pulley half 8*b* toward fixed pulley half 8*a*.

Figure 12:
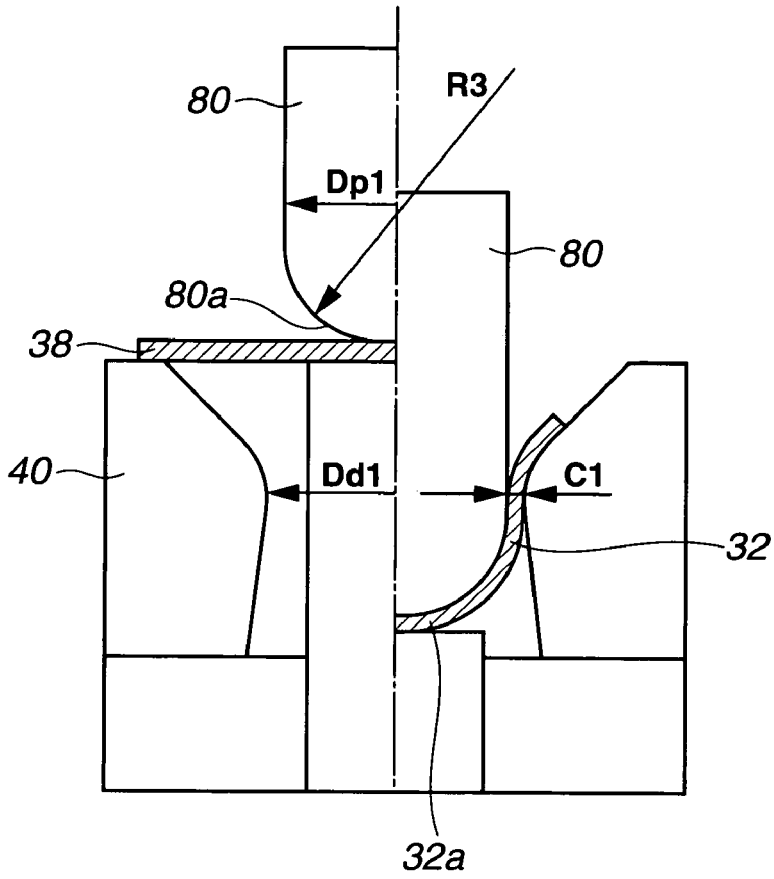
FIG. 12 is an explanatory diagram that shows a first pressing step of a method using an apparatus of a fourth embodiment of the present invention, when viewed in a cross-section taken along an axial direction of the apparatus.
Figure 13:
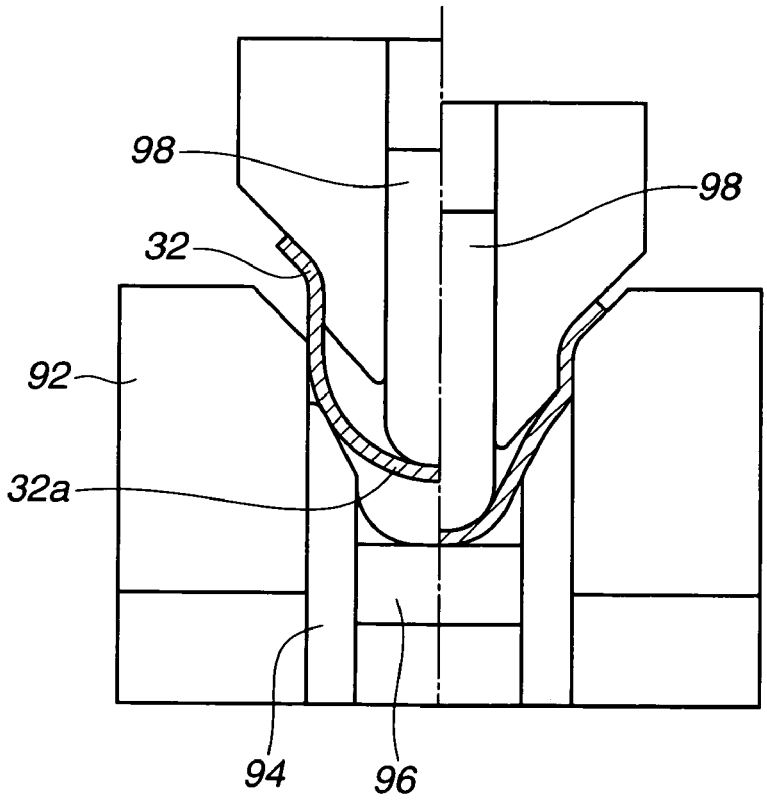
FIG. 13 is an explanatory diagram that shows a bottom molding step of the method using the apparatus of the fourth embodiment of the present invention, when viewed in a cross-section taken along an axial direction of the apparatus.
Figure 14:
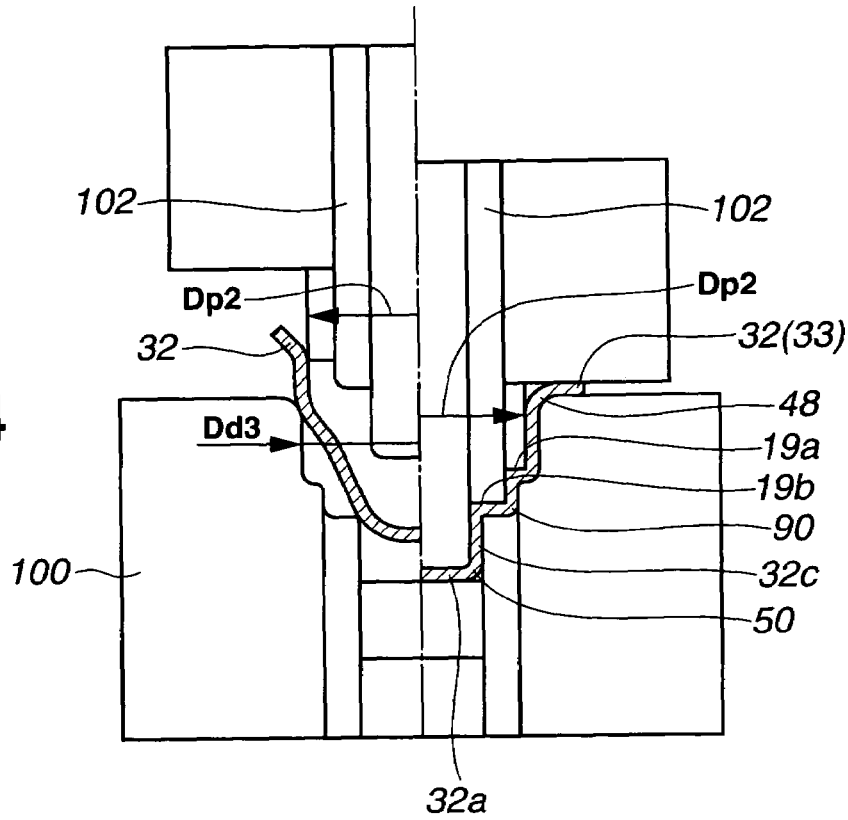
FIG. 14 is an explanatory diagram that shows a second pressing step of the method using the apparatus of the fourth embodiment of the present invention, when viewed in a cross-section taken along an axial direction of the apparatus.
Figure 15:
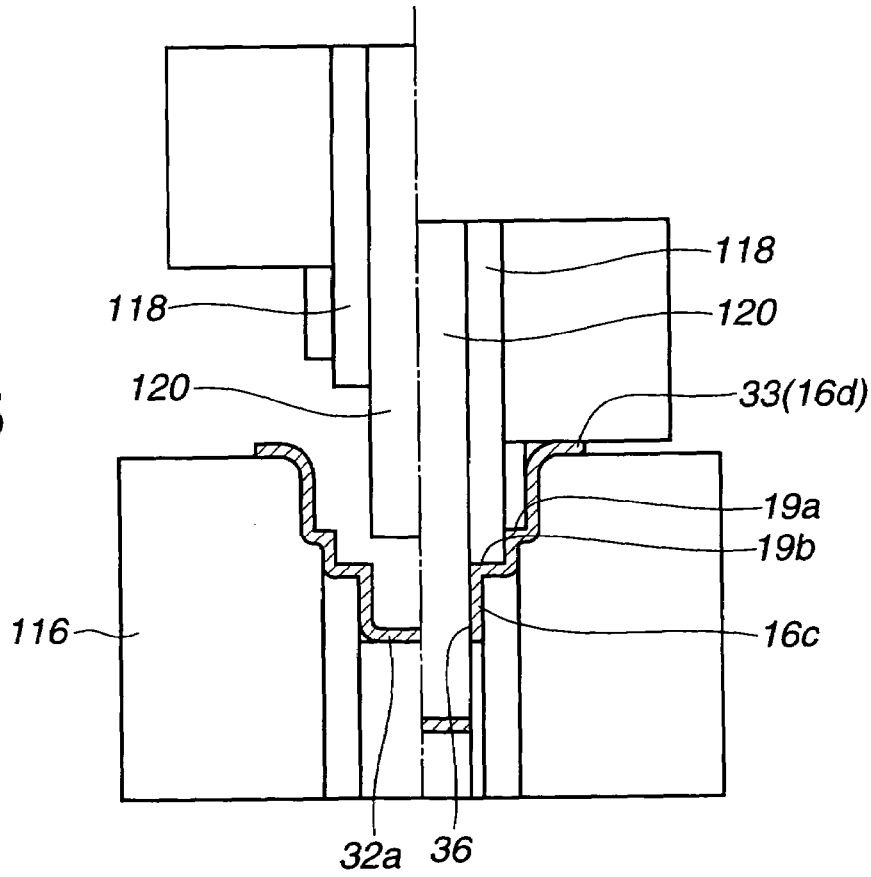
FIG. 15 is an explanatory diagram that shows a third punching step of the method using the apparatus of the fourth embodiment of the present invention, when viewed in a cross-section taken along an axial direction of the apparatus.

Referring to FIGS. 12-18, a fourth embodiment of the method and apparatus for forming a cup-shaped member, according to the present invention will be explained hereinafter. The cup-shaped member is useable as plunger 16*d* of the belt-drive CVT as shown in FIG. 19. FIG. 12 illustrates a first pressing step of the method in which first cup-shaped intermediate molded body 32 is formed using a first molding device. FIG. 13 illustrates a bottom molding step of axially pressing bottom wall 32*a* of first cup-shaped intermediate molded body 32 to form a cylindrical sleeve, and a bottom molding device used in the bottom molding step. FIG. 14 illustrates a second pressing step of the method and a second molding device used in the second pressing step. In the second pressing step, annular first and second bearing surfaces 19*a* and 19*b* are formed on an inner circumferential periphery of first cup-shaped intermediate molded body 32, while first cup-shaped intermediate molded body 32 is formed into second intermediate molded body 33 that has a generally cup-shape similar to plunger 16*d* of FIG. 19. FIG. 15 illustrates a third punching step of the method and a third punching device used in the third punching step. In the third punching step, hole 36 is formed in bottom wall 32*a* of second cup-shaped intermediate molded body 33 to thereby form the cup-shaped member as a final molded body. The first and second molding devices, the bottom molding device and the third punching device constitute the apparatus of the fourth embodiment. In FIGS. 12-15, a pre-state of the molding device before the molding operation is shown on a left side, and a post-state of the molding device after the molding operation is shown on a right side.

As illustrated in FIG. 12, the first molding device of the fourth embodiment is substantially the same as that of the second embodiment as shown in FIG. 7. Like reference numerals denote like parts, and therefore, detailed explanations therefor are omitted. By using the first molding device of the fourth embodiment, there is provided first cup-shaped intermediate molded body 32 that has a substantially uniform wall thickness and generally part-spherical bottom wall 32*a*.

As illustrated in FIG. 13, the bottom molding device includes outer die 92, bottom retainers 94 and 96 and bottom molding punch 98. Outer die 92 retains an outer circumferential periphery of first cup-shaped intermediate molded body 32. Bottom retainers 94 and 96 retain part-spherical bottom wall 32*a* of first cup-shaped intermediate molded body 32 from a lower side thereof. Bottom molding punch 98 is downwardly moveable into the mold cavity formed by outer die 92 and bottom retainers 94 and 96.

As illustrated in FIG. 14, the second molding device includes second die 100 and second punch 102 axially moveable relative to second die 100. Second die 100 and second punch 102 are arranged coaxially with each other and cooperate with each other to form first cup-shaped intermediate molded body 32 into second cup-shaped intermediate molded body 33. Second cup-shaped intermediate molded body 33 includes a central axis and annular first and second bearing surfaces 19*a* and 19*b* that extend perpendicular to a direction of the central axis and are axially spaced from each other. First and second bearing surfaces 19*a* and 19*b* are disposed on radial-inward projections, respectively, that radially inwardly extend from an inner circumferential periphery of second cup-shaped intermediate molded body 33 and are disposed on a radial-inner side and a radial-outer side thereof, respectively. The radial-inward projections have an increased wall thickness as compared to the remaining portions of a circumferential side wall of second cup-shaped intermediate molded body 33. Second cup-shaped intermediate molded body 33 further includes increased-diameter portion 48 on a side of an open end thereof, planar bottom wall 32*a*, bottom side reduced-diameter portion 50 continuously connected with bottom wall 32*a*, and bearing-surface side reduced-diameter portion 90 that extends between the radial-inward projections. Increased-diameter portion 48 is radially outwardly curved with a predetermined radius of curvature. Bottom side reduced-diameter portion 50 is bent relative to bottom wall 32*a*.

Second punch 102 includes a generally cylindrical mold portion with stepped portions which has a mold surface. The mold portion of second punch 102 has outer diameter Dp2 substantially equal to outer diameter Dp1 of the mold portion of first punch 80 of the first molding device. Second die 100 includes a mold surface defining a generally cylindrical mold cavity with stepped portions which cooperates with the mold surface of second punch 102. The mold cavity of second die 100 has inner diameter Dd3 smaller than inner diameter Dd1 of the mold cavity of first die 40 of the first molding device. Second die 100 and second punch 102 include open-end side plastic flow restraining portions that cooperate with each other to restrain plastic flow of the metal material of first cup-shaped intermediate molded body 32 which is directed toward an open end periphery thereof. Second die 100 and second punch 102 further include bottom side plastic flow restraining portions that cooperate with each other to restrain plastic flow of the metal material of first cup-shaped intermediate molded body 32 which is directed toward a bottom thereof. Second die 100 and second punch 102 further include intermediate plastic flow restraining portions that cooperate with each other to restrain plastic flow of the metal material of first cup-shaped intermediate molded body 32 which is caused between a first area of first cup-shaped intermediate molded body 32 in which annular first bearing surface 19*a* is formed, and a second area of first cup-shaped intermediate molded body 32 in which annular second bearing surface 19*b* is formed, respectively.

Specifically, as illustrated in FIG. 14, the mold portion of second punch 102 includes first step surface 104 and second step surface 106 which extends perpendicular to an axial direction of second punch 102 and are spaced apart from each other in the axial direction of second punch 102. First step surface 104 and second step surface 106 are located on the stepped portion on a radial-outer side and the stepped portion on a radial-inner side, respectively. Step surface 104 acts as a mold surface to form annular first bearing surface 19*a* of second cup-shaped intermediate molded body 33. Step surface 106 acts as a mold surface to form annular second bearing surface 19*b* of second cup-shaped intermediate molded body 33. Each of step surfaces 104 and 106 is in the form of an annular planar surface.

Figure 16:
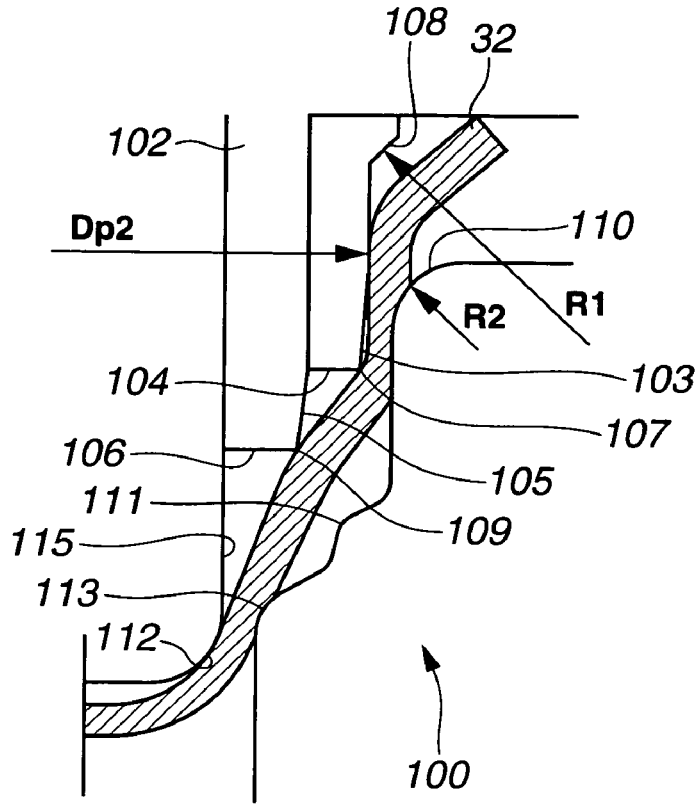
FIG. 16 is an explanatory diagram that shows an initial stage of the second pressing step of the method in the fourth embodiment of the present invention.
Figure 17:
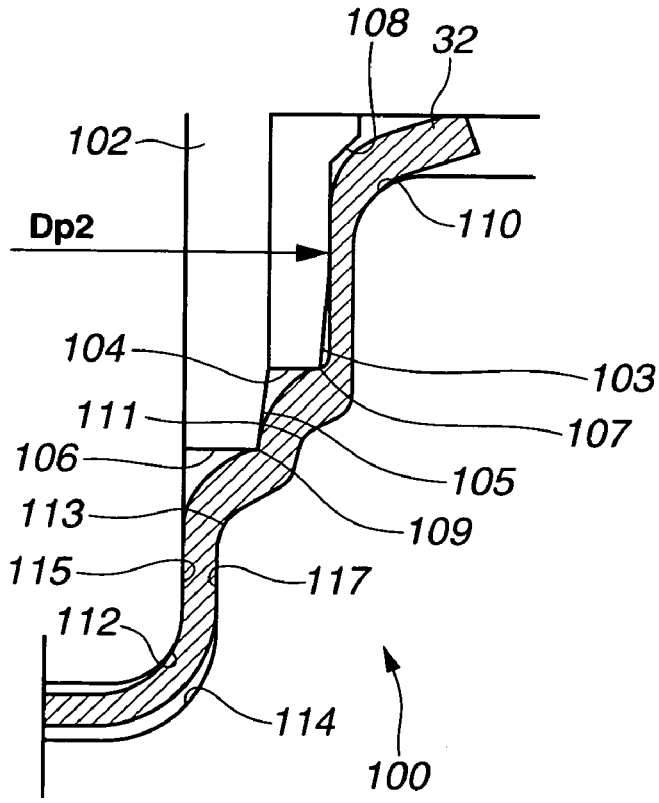
FIG. 17 is an explanatory diagram that shows a middle stage of the second pressing step of the method in the fourth embodiment of the present invention.

As illustrated in FIGS. 16 and 17, the mold portion of second punch 102 further includes upper tapered portion 103 that is gradually tapered toward step surface 104 and connected therewith to form the radial-outer side stepped portion. The radial-outer side stepped portion has rounded corner 107 between step surface 104 and tapered portion 103 which has a small radius of curvature. The mold portion of second punch 102 further includes a cylindrical mold portion continuously connected at a lower side thereof with upper tapered portion 103. The cylindrical mold portion has outer diameter Dp2 that is larger than an outer diameter of annular step surface 104. The mold portion of second punch 102 further includes lower tapered portion 105 that extends between step surfaces 104 and 106. Lower tapered portion 105 is gradually tapered toward step surface 106 and connected therewith to form the radial-inner side stepped portion. The radial-inner side stepped portion has rounded corner 109 between step surface 106 and lower tapered portion 105 which has a small radius of curvature. Lower tapered portion 105 acts to form bearing-surface side reduced-diameter portion 90 of second cup-shaped intermediate molded body 33 as shown in FIG. 18.

As illustrated in FIG. 16, the mold portion of second punch 102 further includes increased-diameter mold surface 108 continuously connected with an upper side of the cylindrical mold portion that has outer diameter Dp2. Increased-diameter mold surface 108 is radially outwardly curved to have relatively large radius of curvature R1. The mold portion of second punch 102 further includes a bottom mold surface on a tip end thereof and reduced-diameter mold surface 112 connected with the bottom mold surface. The bottom mold surface acts to form planar bottom wall 32*a* of second cup-shaped intermediate molded body 33 as shown in FIG. 18. Reduced-diameter mold surface 112 is downwardly spaced from step surface 106 and bent relative to the bottom mold surface to make an obtuse angle therebetween. The mold portion of second punch 102 further includes sleeve mold surface 115 that is disposed between reduced-diameter mold surface 112 and step surface 106. Sleeve mold surface 115 acts to form cylindrical portion 32*c* of second cup-shaped intermediate molded body 33 which is formed into sleeve 16*c* in the subsequent third punching step as shown in FIG. 15.

Figure 18:
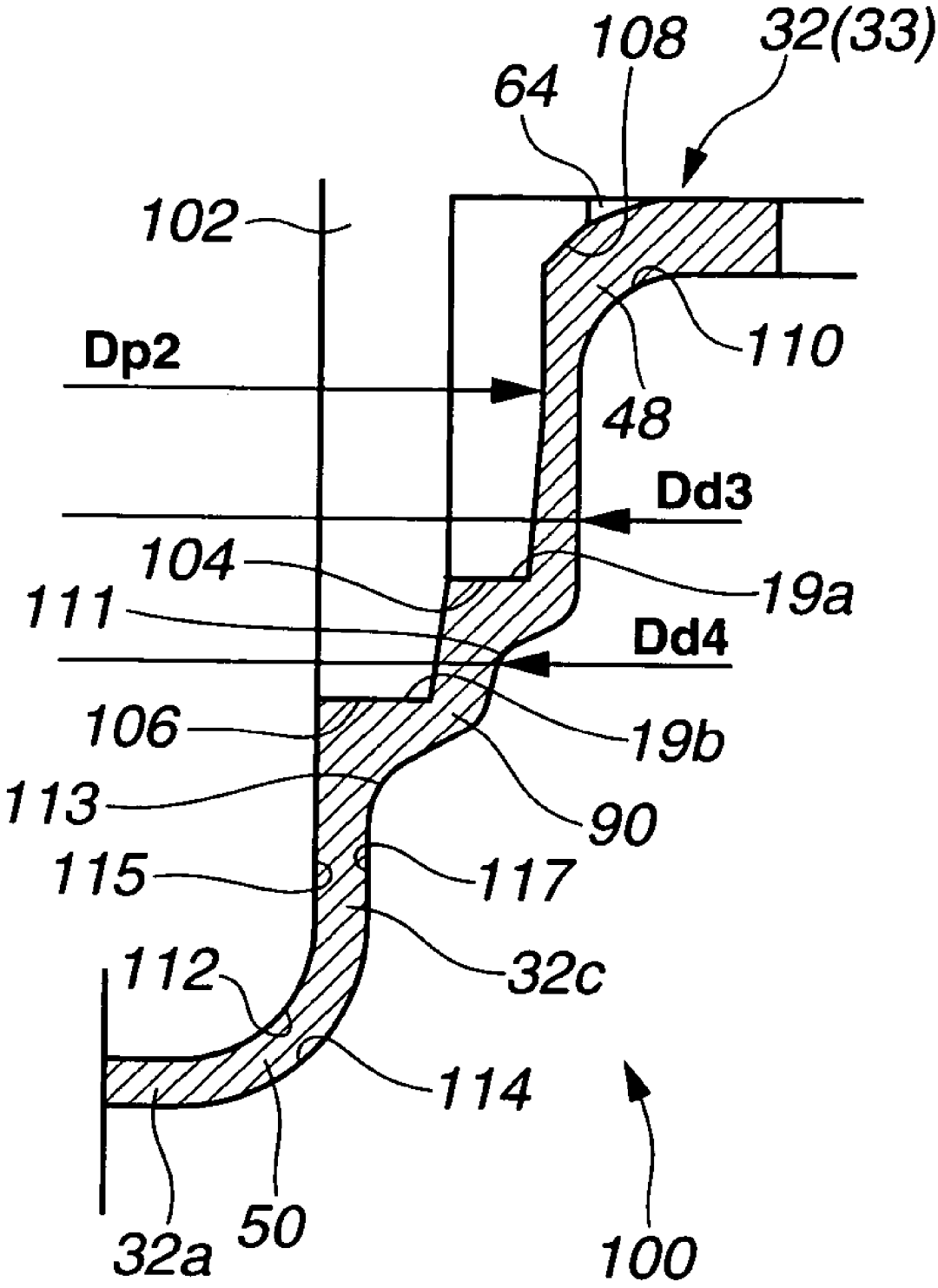
FIG. 18 is an explanatory diagram that shows a later stage of the second pressing step of the method in the fourth embodiment of the present invention.

As illustrated in FIG. 18, the mold surface of second die 100 includes a cylindrical upper mold surface that has inner diameter Dd3, and increased-diameter mold surface 110 that is continuously connected with an upper side of the cylindrical upper mold surface. Increased-diameter mold surface 110 is radially outwardly curved toward an upper end surface of second die 100. Increased-diameter mold surface 110 has radius of curvature R2 that is smaller than radius of curvature R1 of increased-diameter mold surface 108 of second punch 102. Increased-diameter mold surface 110 cooperates with increased-diameter mold surface 108 to form increased-diameter portion 48 of second cup-shaped intermediate molded body 33 as shown in FIG. 18.

As illustrated in FIG. 16, the mold surface of second die 100 further includes step surfaces 111 and 113. Step surface 111 radially inwardly extends from a lower side of the cylindrical upper mold surface and is downwardly bent toward the bottom of the mold cavity. Step surface 111 cooperates with step surface 104 of second punch 102 to form first bearing surface 19*a* of second cup-shaped intermediate molded body 33 as shown in FIG. 18. Step surface 113 is downwardly spaced from step surface 111 and located on a radial-inner side thereof. Step surface 113 is downwardly bent toward the bottom of the mold cavity. Step surface 113 cooperates with step surface 106 of second punch 102 to form second bearing surface 19*b* of second cup-shaped intermediate molded body 33 as shown in FIG. 18. As illustrated in FIG. 18, the mold surface of second die 100 further includes a cylindrical lower mold surface that extends between step surfaces 111 and 113. The cylindrical lower mold surface has inner diameter Dd4 smaller than inner diameter Dd3 of the cylindrical upper mold surface that extends between increased-diameter mold surface 110 and step surface 111.

The mold surface of second die 100 further includes a bottom mold surface and reduced-diameter mold surface 114 connected with the bottom mold surface. The bottom mold surface is disposed at the bottom of the mold cavity of second die 100 and cooperates with the bottom mold surface of second punch 102 to form planar bottom wall 32*a* of second cup-shaped intermediate molded body 33 as shown in FIG. 18. Reduced-diameter mold surface 114 is downwardly spaced from step surface 113 and located on a radial-inner side thereof. Reduced-diameter mold surface 114 is bent with respect to the bottom mold surface to make an obtuse angle that is larger than the obtuse angle of reduced-diameter mold surface 112 of second punch 102. Reduced-diameter mold surface 114 cooperates with reduced-diameter mold surface 112 of second punch 102 to form reduced-diameter portion 50 of second cup-shaped intermediate molded body 33 as shown in FIG. 18.

The mold surface of second die 100 further includes sleeve mold surface 117 disposed between reduced-diameter mold surface 114 and step surface 113. Sleeve mold surface 117 cooperates with sleeve mold surface 115 of second punch 102 to form cylindrical portion 32*c* of second cup-shaped intermediate molded body 33 as shown in FIG. 18. The mold surface of second die 100 further includes a mold surface that corresponds to the radial-inner side stepped portion between step surfaces 104 and 106 of second punch 102 and cooperates therewith to form bearing-surface side reduced-diameter portion 90 of second cup-shaped intermediate molded body 33 as shown in FIG. 18.

Increased-diameter mold surface 108 of second punch 102 acts as one of the open-end side plastic flow restraining portions for restraining the plastic flow of the metal material of first cup-shaped intermediate molded body 32 which is directed toward the open end periphery thereof, and increased-diameter mold surface 110 of second die 100 acts as the other of the open-end side plastic flow restraining portions. Second die 100 and second punch 102 cooperate with each other to define non-molding space 64 on an outside of both of increased-diameter mold surface 110 of second die 100 and increased-diameter mold surface 108 of second punch 102. In non-molding space 64, first cup-shaped intermediate molded body 32 is free from being pressed by second die 100 and second punch 102.

Reduced-diameter mold surface 112 of second punch 102 acts as one of the bottom side plastic flow restraining portions for restraining the plastic flow of the metal material of first cup-shaped intermediate molded body 32 which is directed toward the bottom thereof, and reduced-diameter mold surface of second die 100 acts as the other of the bottom side plastic flow restraining portions. The mold surface between step surfaces 104 and 106 of second punch 102 and the corresponding mold surface of second die 100 act as the intermediate plastic flow restraining portions that cooperate with each other to restrain plastic flow caused between the first area of first cup-shaped intermediate molded body 32 in which first bearing surface 19*a* is formed, and the second area of first cup-shaped intermediate molded body 32 in which the second bearing surface 19*b* is formed, respectively.

As illustrated in FIG. 15, the third punching device of the fourth embodiment includes third die 116, retainer 118 moveable relative to third die 116, and third punch 120 that is disposed coaxially with retainer 118 and moveable relative to third die 116. Third die 116, retainer 118 and third punch 120 cooperate with one another to form second cup-shaped intermediate molded body 33 into cup-shaped member 33 as a final molded body which has hole 36 in bottom wall 32*a* thereof. Hole 36 acts as a shaft insertion hole into which the driven shaft of the belt-drive CVT is inserted.

Third die 116 has a mold cavity and a support surface defining the mold cavity. An outside surface of second cup-shaped intermediate molded body 33 is placed on the support surface and supported thereby. Retainer 118 has a retaining surface on a tip end portion thereof, which retains an inside surface of second cup-shaped intermediate molded body 33. Third punch 120 has a punching surface that comes into contact with a central portion of the inside surface of bottom wall 32*a* of second intermediate molded body 33 and punches hole 36 through bottom wall 32*a* thereof.

Referring to FIGS. 12-18, the method of forming the cup-shaped member using the apparatus of the fourth embodiment of the present invention is explained. In the first pressing step as illustrated in FIG. 12, plate 38 is set on first die 40 of the first molding device. First punch 80 is downwardly moved into the mold cavity of first die 40, while pressing against plate 38 set on first die 40. First cup-shaped intermediate molded body 32 that has part-spherical bottom wall 32*a* and the substantially uniform wall thickness is thus formed.

Subsequently, as shown in FIG. 13, the bottom molding step is conducted. First cup-shaped intermediate molded body 32 is set on outer die 92 and bottom retainer 94. Bottom molding punch 98 is downwardly moved into the mold cavity formed by outer die 92 and bottom retainers 94 and 96 while pressing against generally part-spherical bottom wall 32*a* of first cup-shaped intermediate molded body 32 so as to form an axially elongated cylindrical portion at a central portion of bottom wall 32*a*.

Next, in the second pressing step as shown in FIG. 14, first cup-shaped intermediate molded body 32 with axially elongated cylindrical bottom wall 32*a* is formed into second cup-shaped intermediate molded body 33. First cup-shaped intermediate molded body 32 with axially elongated cylindrical bottom wall 32*a* is set on second die 100 as shown on the left side of FIG. 14. In this state, there is a space between the outside surface of first cup-shaped intermediate molded body 32 and the mold surface of second die 100. Second punch 102 is downwardly moved into the mold cavity of second die 100 while pressing against first cup-shaped intermediate molded body 32 on second die 100. During this pressing step, an outer circumferential periphery of first cup-shaped intermediate molded body 32 is ironed and pulled into the mold cavity of second die 100 as shown on the right side of FIG. 14 and FIGS. 16 and 17. Since outer diameter Dp2 of the mold portion of second punch 102 is substantially equal to outer diameter Dp1 of the mold portion of first punch 80, and inner diameter Dd3 of the mold cavity of second die 100 is smaller than inner diameter Dd1 of the mold cavity of first die 80, the outer circumferential periphery of first cup-shaped intermediate molded body 32 is forcibly ironed when first cup-shaped intermediate molded body 32 is urged into the mold cavity of second die 100 by second punch 102 while being pressed therebetween. Thus, there occurs plastic flow of the metal material of first cup-shaped intermediate molded body 32.

Further, as illustrated in FIG. 18, increased-diameter mold surface 108 of second punch 102 and increased-diameter mold surface 110 of second die 100 cooperate with each other to press the open-end side of first cup-shaped intermediate molded body 32 therebetween and form the open-end side thereof into increased-diameter portion 48 of second cup-shaped intermediate molded body 33. At the same time, reduced-diameter mold surface 112 of second punch 102 and reduced-diameter mold surface 114 of second die 100 cooperate with each other to press the bottom side of first cup-shaped intermediate molded body 32 therebetween and form the bottom side thereof into bottom side reduced-diameter portion 50 of second cup-shaped intermediate molded body 33. As a result, the plastic flow of the metal material of first cup-shaped intermediate molded body 32 which is caused by ironing the outer circumferential periphery thereof is interrupted at increased-diameter portion 48 on the open-end side and reduced-diameter portion 50 on the bottom side. Further, the mold surface between step surfaces 104 and 106 of second punch 102 and the corresponding mold surface between step surfaces 111 and 113 of second die 100 cooperate with each other to press first cup-shaped intermediate molded body 32 therebetween and form bearing-surface side reduced-diameter portion 90 of second cup-shaped intermediate molded body 33. The plastic flow of the metal material of first cup-shaped intermediate molded body 32 which is caused between step surfaces 104 and 106 of second punch 102 is restrained by bearing-surface side reduced-diameter portion 90. As a result, the plastic flow that is radially inwardly directed from the inner circumferential periphery of first cup-shaped intermediate molded body 32 is facilitated toward step surfaces 104 and 106 of second punch 102. Then, the plastic flow that is radially inwardly directed smoothly runs along tapered surfaces 103 and 105 adjacent to step surfaces 104 and 106 such that the wall thickness of first cup-shaped intermediate molded body 32 between step surfaces 111 and 113 of second die 100 and step surfaces 104 and 106 of second punch 102 is increased to thereby form the radial-inward projections with first and second bearing surfaces 19*a* and 19*b*. As a result, as shown in FIGS. 14 and 18, second cup-shaped intermediate molded body 33 is formed with first and second bearing surfaces 19*a* and 19*b* on the radial-inward projections having the increased wall thickness, and cylindrical portion 32*c* that extends in a direction perpendicular to first and second bearing surfaces 19*a* and 19*b*.

Subsequently, as illustrated in FIG. 15, the third punching step is conducted. Second cup-shaped intermediate molded body 33 formed in the second pressing step is set on third die 116. Retainer 118 is downwardly moved into the mold cavity of third die 116 and placed on second intermediate molded body 33 on third die 116. At this time, retainer 118 is in contact with the outer circumferential portion of the inside surface of bottom wall 32*a* of second intermediate molded body 33. Retainer 118 cooperates with third die 116 to support bottom wall 32*a* of second cup-shaped intermediate molded body 33 therebetween. Subsequently, third punch 120 is downwardly moved and punches hole 36 at a central portion of bottom wall 32*a* of second cup-shaped intermediate molded body 33. Thus, there is provided cup-shaped member 33 that has sleeve 16*c*, hole 36 in bottom wall 32*a* and annular first and second bearing surfaces 19*a* and 19*b* on the radial-inward projections that have an increased wall thickness as compared to the remaining portions.

The fourth embodiment of the present invention has the following effects in addition to the above-explained effects of the first embodiment. In the second pressing step after the first pressing step in which first cup-shaped intermediate molded body 32 having a substantially uniform wall thickness, the outer circumferential periphery of first cup-shaped intermediate molded body 32 is ironed to cause plastic flow of the metal material of first cup-shaped intermediate molded body 32 and restrain the plastic flow directed toward the open end periphery and bottom wall 32*a* of first cup-shaped intermediate molded body 32 by forming increased-diameter portion 48 on the open end side and reduced-diameter portion 50 on the bottom side. At the same time, the plastic flow caused between step surfaces 104 and 106 of second punch 102 is restrained by forming bearing-surface side reduced-diameter portion 90. This results in facilitating the plastic flow directed toward step surfaces 104 and 106 of second punch 102 to thereby form annular first and second bearing surfaces 19*a* and 19*b* on the radial-inward projections that have an increased wall thickness. Thus, second cup-shaped intermediate molded body 33 having annular first and second bearing surfaces 19*a* and 19*b* on the radial-inward projections that have an increased wall thickness can be formed by the number of steps of the method that is reduced as compared to the conventional art.

Further, in the bottom molding step, generally part-spherical bottom wall 32*a* of first cup-shaped intermediate molded body 32 is formed into the axially elongated cylindrical shape by pressing against bottom wall 32*a* in the axial direction. The elongated cylindrical bottom wall 32*a* can be readily formed into cylindrical portion 32*c* of second cup-shaped intermediate molded body 33 in the subsequent second pressing step. Cylindrical portion 32*c* is formed into sleeve 16*c* of cup-shaped member 16*d* in the subsequent third punching step.

Further, since first and second bearing surfaces 19*a* and 19*b* on the radial-inward projections having an increased wall thickness can be formed by the reduced number of steps of the method as explained above, the number of dies and punches of the apparatus for forming the cup-shaped member can be reduced, and therefore, the equipment cost and the production cost can be reduced.

This application is based on prior Japanese Patent Application No. 2004-360145 filed on Dec. 13, 2004 and Japanese Patent Application No. 2005-318279 filed on Nov. 1, 2005, the entire contents of which is hereby incorporated by reference.

Although the invention has been described above by reference to embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A method for forming a cup-shaped member, the method comprising:

a first pressing step of pressing a plate into a first cup-shaped intermediate molded body that has a substantially uniform wall thickness; and a second pressing step of pressing the first cup-shaped intermediate molded body into a second cup-shaped intermediate molded body, the second cup-shaped intermediate molded body including at least one annular bearing surface that extends perpendicular to an axial direction of the second cup-shaped intermediate molded body, the at least one annular bearing surface being disposed on a radial-inward projection that radially inwardly extends from an inner circumferential periphery of the second cup-shaped intermediate molded body and has an increased wall thickness, wherein during the second pressing step, an outer circumferential periphery of the first cup-shaped intermediate molded body is ironed to facilitate plastic flow that is radially inwardly directed from the inner circumferential periphery thereof by restraining plastic flow that is directed toward an open end periphery and a bottom of the first cup-shaped intermediate molded body to thereby form the at least one annular bearing surface on the radial-inward projection, and wherein during the first pressing step, the plate is formed into the first cup-shaped intermediate molded body that has a generally part-spherical bottom wall, and during the second pressing step, the generally part-spherical bottom wall of the first cup-shaped intermediate molded body is pressed to facilitate plastic flow that is directed from the generally part-spherical bottom wall toward an area in which the at least one annular bearing surface is formed.

2. The method as claimed in claim 1, wherein during the first pressing step, the plate is formed into the first cup-shaped intermediate molded body that has a planar plate-shaped bottom wall, the method further comprising between the first pressing step and the second pressing step, a wall thickness increasing step of pressing the first cup-shaped intermediate molded body in an axial direction thereof to increase a wall thickness of an area in which the at least one annular bearing surface is formed.

3. The method as claimed in claim 1, further comprising after the second step, a third punching step of forming a hole at a bottom of the second cup-shaped intermediate molded body to thereby form the cup-shaped member as a final molded body.

4. The method as claimed in claim 3, wherein the cup-shaped member as a final molded body is used as a plunger of a belt-drive continuously variable transmission.

5. A method for forming a cup-shaped member, the method comprising:

a first pressing step of pressing a plate into a first cup-shaped intermediate molded body that has a substantially uniform wall thickness; and a second pressing step of pressing the first cup-shaped intermediate molded body into a second cup-shaped intermediate molded body, the second cup-shaped intermediate molded body including at least one annular bearing surface that extends perpendicular to an axial direction of the second cup-shaped intermediate molded body, the at least one annular bearing surface being disposed on a radial-inward projection that radially inwardly extends from an inner circumferential periphery of the second cup-shaped intermediate molded body and has an increased wall thickness, wherein during the second pressing step, an outer circumferential periphery of the first cup-shaped intermediate molded body is ironed to facilitate plastic flow that is radially inwardly directed from the inner circumferential periphery thereof by restraining plastic flow that is directed toward an open end periphery and a bottom of the first cup-shaped intermediate molded body to thereby form the at least one annular bearing surface on the radial-inward projection, wherein in the second pressing step, the first cup-shaped intermediate molded body is formed into the second cup-shaped intermediate molded body having annular first and second bearing surfaces that extend perpendicular to the axial direction of the second cup-shaped intermediate molded body and are disposed in an axially spaced relation to each other, the annular first and second bearing surfaces being disposed on first and second radial-inward projections that radially inwardly extend from the inner circumferential periphery of the second cup-shaped intermediate molded body and have an increased wall thickness, and wherein during the second pressing step, the outer circumferential periphery of the first cup-shaped intermediate molded body is ironed to facilitate the plastic flow that is radially inwardly directed from the inner circumferential periphery thereof by restraining the plastic flow that is directed toward an open end periphery and a bottom of the first cup-shaped intermediate molded body and by restraining plastic flow that is caused between a first area of the first cup-shaped intermediate molded body in which the first bearing surface is formed and a second area of the first cup-shaped intermediate molded body in which the second bearing surface is formed to thereby form the first and second bearing surfaces on the first and second radial-inward projections.

6. The method as claimed in claim 5, further comprising between the first pressing step and the second pressing step, a bottom molding step of axially pressing the bottom of the first cup-shaped intermediate molded body to form an axially elongated cylindrical portion at a central portion of the bottom of the first cup-shaped intermediate molded body.

7. The method as claimed in claim 5, further comprising after the second step, a third punching step of forming a hole at a bottom of the second cup-shaped intermediate molded body to thereby form the cup-shaped member as a final molded body.

8. The method as claimed in claim 7, wherein the cup-shaped member as a final molded body is used as a plunger of a belt-drive continuously variable transmission.

9. An apparatus for forming a cup-shaped member comprising components adapted to form the cup-shaped member so that it has at least one annular bearing surface that extends perpendicular to an axial direction of the cup-shaped member, the at least one annular bearing surface being disposed on a radial-inward projection that radially inwardly extends from an inner circumferential periphery of the cup-shaped member and has an increased wall thickness, the apparatus further comprising:

a first die;

a first punch cooperating with the first die to form a plate into a first cup-shaped intermediate molded body that has a substantially uniform wall thickness;

a second die; and a second punch cooperating with the second die to form the first cup-shaped intermediate molded body into a second cup-shaped intermediate molded body, the second punch including at least one annular step surface that extends perpendicular to an axial direction of the second punch and acts to form the at least one annular bearing surface of the cup-shaped member, the second die and the second punch including open-end side plastic flow restraining portions cooperating with each other to restrain plastic flow that is directed toward an open end periphery of the first cup-shaped intermediate molded body, and bottom side plastic flow restraining portions cooperating with each other to restrain plastic flow that is directed toward a bottom of the first cup-shaped intermediate molded body to thereby form the at least one annular bearing surface on the radial-inward projection, wherein the apparatus is adapted so that when the first punch cooperates with the first die to form the plate into the first cup-shaped intermediate molded body, the first cup-shaped intermediate molded body has a generally part-spherical bottom wall, and wherein the apparatus is adapted so that when the second punch cooperates with the second die to form the first cup-shaped intermediate molded body into the second cup-shaped intermediate molded body, the generally part-spherical bottom wall of the first cup-shaped intermediate molded body is pressed to facilitate plastic flow that is directed from the generally part-spherical bottom wall toward an area in which the at least one annular bearing surface is formed.

10. The apparatus as claimed in claim 9, wherein the second punch comprises annular first and second step surfaces that extend perpendicular to an axial direction of the second punch and act to form annular first and second bearing surfaces of the cup-shaped member, and the second die and the second punch further comprise intermediate plastic flow restraining portions cooperating with each other to restrain plastic flow caused between a first area of the first cup-shaped intermediate molded body in which the first bearing surface is formed, and a second area of the first cup-shaped intermediate molded body in which the second bearing surface is formed.

11. The apparatus as claimed in claim 9, wherein the first punch includes a first mold portion, the second punch including a second mold portion that has an outer diameter substantially equal to an outer diameter of the first mold portion of the first punch, the outer diameter of the second mold portion being larger than an outer diameter of the at least one annular step surface, the first die including a first mold surface, the second die including a step surface that cooperates with the at least one annular step surface of the second punch to form the at least one annular bearing surface, and a second mold surface that has an inner diameter smaller than an inner diameter of the first mold surface of the first die, the second mold surface being disposed between the open-end side plastic flow restraining portion and the step surface.

12. The apparatus as claimed in claim 11, wherein the second punch includes a tapered portion that is gradually tapered toward the at least one annular step surface.

13. The apparatus as claimed in claim 9, wherein the open-end side plastic flow restraining portion of the second punch includes an increased-diameter mold surface that is radially outwardly curved to have a radius of curvature, the open-end side plastic flow restraining portion of the second die including an increased-diameter mold surface that is radially outwardly curved to have a radius of curvature smaller than the radius of curvature of the increased-diameter mold surface of the second punch, the increased-diameter mold surface of the second punch pressing against an open-end side of the first cup-shaped intermediate molded body.

14. The apparatus as claimed in claim 9, wherein the bottom side plastic flow restraining portion of the second die includes a reduced-diameter mold surface that is bent relative to a bottom of the second die to make a first obtuse angle therebetween, the bottom side plastic flow restraining portion of the second punch including a reduced-diameter mold surface that is bent relative to a tip end of the second punch to make a second obtuse angle therebetween that is smaller than the first obtuse angle, the reduced-diameter mold surface of the second punch pressing against a bottom side of the first cup-shaped intermediate molded body.

15. The apparatus as claimed in claim 9, wherein the second die and the second punch cooperate with each other to define a non-molding space on an outside of the open-end side plastic flow restraining portions in which the first cup-shaped intermediate molded body is free from being pressed by the second die and the second punch.

16. The apparatus as claimed in claim 9, further comprising a third die and a third punch which cooperate with each other to form a hole at a bottom of the second cup-shaped intermediate molded body to thereby form the cup-shaped member as a final molded body.

17. The apparatus as claimed in claim 16, wherein the cup-shaped member as a final molded body is used as a plunger of a belt-drive continuously variable transmission.

* * * * *